US008248315B2

(12) United States Patent
Lindackers et al.

(10) Patent No.: US 8,248,315 B2
(45) Date of Patent: Aug. 21, 2012

(54) INTERCHANGEABLE SLIDABLY MOUNTABLE FINS FOR ANTENNA ASSEMBLIES

(75) Inventors: Ralf Lindackers, Royal Oak, MI (US); Ayman Duzdar, Holly, MI (US); Joseph M. Combi, Grand Blanc, MI (US); Huzefa A. Bharmal, Rochester Hills, MI (US)

(73) Assignee: Laird Technologies, Inc., Earth City, MO (US)

( * ) Notice: Subject to any disclaimer, the term of this patent is extended or adjusted under 35 U.S.C. 154(b) by 340 days.

(21) Appl. No.: 12/236,670

(22) Filed: Sep. 24, 2008

(65) Prior Publication Data

US 2010/0277379 A1 Nov. 4, 2010

Related U.S. Application Data

(63) Continuation-in-part of application No. 11/962,471, filed on Dec. 21, 2007, now Pat. No. 7,755,551, which is a continuation-in-part of application No. 11/271,372, filed on Nov. 10, 2005, now Pat. No. 7,333,065.

(51) Int. Cl.
*H01Q 1/32* (2006.01)

(52) U.S. Cl. ..... 343/713; 343/711; 343/872; 343/878; 343/705

(58) Field of Classification Search ..... 343/906, 343/915, 846, 881, 792.5, 781 P, 758, 708, 343/705, 703, 765, 883, 719, 873, 761, 768, 343/763, 750, 771

See application file for complete search history.

(56) References Cited

U.S. PATENT DOCUMENTS

| | | | | |
|---|---|---|---|---|
| 5,392,350 | A * | 2/1995 | Swanson | 379/446 |
| 6,916,220 | B2 | 7/2005 | Davey et al. | |
| 7,091,912 | B2 | 8/2006 | Iacovella et al. | |
| 7,212,168 | B2 | 5/2007 | Kozlovski | |
| 7,236,136 | B2 | 6/2007 | Noro | |
| 7,239,281 | B2 | 7/2007 | Lu | |
| 7,268,734 | B2 | 9/2007 | Cislo | |
| 7,304,614 | B2 | 12/2007 | Silva | |
| 7,333,065 | B2 * | 2/2008 | Lindackers et al. | 343/713 |
| 7,725,083 | B1 * | 5/2010 | Sullivan | 455/95 |
| 7,755,551 | B2 * | 7/2010 | Lindackers et al. | 343/713 |
| 2005/0219131 | A1 | 10/2005 | Haidacher et al. | |
| 2007/0103374 | A1 * | 5/2007 | Lindackers et al. | 343/713 |
| 2008/0012776 | A1 | 1/2008 | Blickle | |
| 2008/0111752 | A1 * | 5/2008 | Lindackers et al. | 343/713 |

* cited by examiner

*Primary Examiner* — Trinh Dinh

(74) *Attorney, Agent, or Firm* — Harness, Dickey & Pierce, P.L.C.

(57) ABSTRACT

An antenna assembly for installation to a mobile platform includes a base portion and an antenna module capable of being removably coupled to the base portion. The base portion includes a longitudinal axis and defines a channel extending along at least part of the longitudinal axis. The antenna module includes a mount and an antenna element coupled to the mount. The mount and antenna element can be received into the channel of the base portion, in electrical contact with the base portion, and then subsequently removed from the channel of the base portion as desired. Further, the base portion of the antenna assembly is configured to accommodate multiple different antenna modules as desired.

34 Claims, 17 Drawing Sheets

INTERCHANGEABLE SLIDABLY MOUNTABLE FINS FOR ANTENNA ASSEMBLIES

CROSS-REFERENCE TO RELATED APPLICATIONS

This application is a continuation-in-part of U.S. patent application Ser. No. 11/962,471 filed Dec. 21, 2007 (now U.S. Pat. No. 7,755,551 issued Jul. 13, 2010), which, in turn, is a continuation-in-part of U.S. patent application Ser. No. 11/271,372 filed Nov. 10, 2005 (now U.S. Pat. No. 7,333,065 issued Feb. 19, 2008).

FIELD

The present disclosure generally relates to antenna assemblies, and more particularly to antenna assemblies having antenna modules that can be slidably coupled to chassis of the antenna assemblies.

BACKGROUND

This section provides background information related to the present disclosure which is not necessarily prior art.

Various types of antennas are used in the automotive industry, including AM/FM antennas, patch antennas, etc. Antennas for automotive use are commonly positioned on the vehicle's roof, hood, or trunk lid to help ensure that the antenna has an unobstructed view overhead or toward the zenith.

SUMMARY

This section provides a general summary of the disclosure, and is not a comprehensive disclosure of its full scope or all of its features.

According to various aspects, example embodiments are provided of antenna assemblies and their components for installation mobile platforms, and methods related to installation of antenna assemblies. In one example embodiment, an antenna assembly is configured for installation to a mobile platform. The antenna assembly generally includes a base portion having a longitudinal axis and defining a channel extending generally along at least part of the longitudinal axis, a mount removably receivable within the channel of the base portion, and an antenna element coupled to the mount. The antenna element is tuned to receive electrical resonance frequencies over one or more bandwidth.

In another example embodiment, an antenna assembly configured for installation to a mobile platform generally includes a base portion having a longitudinal axis and defining a channel extending generally along at least part of the longitudinal axis. The channel includes first and second side walls and first and second projecting portions. The first projecting portion extends generally along at least part of the first side wall, and the second projecting portion extending generally along at least part of the second side wall. The antenna assembly also includes a mount having first and second side walls and first and second slots. The first slot extends generally along the first side wall, and the second slot extending generally along the second side wall. The antenna assembly further includes an antenna element coupled to the mount. The antenna element is tuned to receive electrical resonance frequencies over one or more bandwidths. The first and second projecting portions of the base portion's channel are received at least partially within the respective first and second slots of the mount to thereby releasably couple the mount to the base portion at least partially within the channel of the base portion.

In another example embodiment, an antenna module is capable of being coupled to a base portion of an antenna assembly for installation to a mobile platform. The antenna module generally includes a mount having at least one slot extending generally longitudinally along at least part of the mount, and an antenna element coupled to the mount. The antenna element tuned to receive electrical resonance frequencies over one or more bandwidths, and the mount is capable of being removably coupled to a chassis.

In still another example embodiment, a base portion of an antenna assembly is suitable for receiving multiple different interchangeable antenna modules onto the base portion for installation to a mobile platform. The base portion generally includes a channel extending generally longitudinally along at least part of the base portion. The channel has at least one projecting portion extending generally longitudinally along at least part of the channel. The base portion is capable of removably receiving at least part of an antenna module for releasably coupling the antenna module to the base portion.

In another example embodiment, a method relating to installation of antenna assemblies to vehicle body walls generally includes mounting a base portion of the antenna assembly on a mobile platform, and coupling an antenna module of the antenna assembly to the base portion by sliding the first antenna module generally longitudinally into a longitudinal channel of the base portion.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
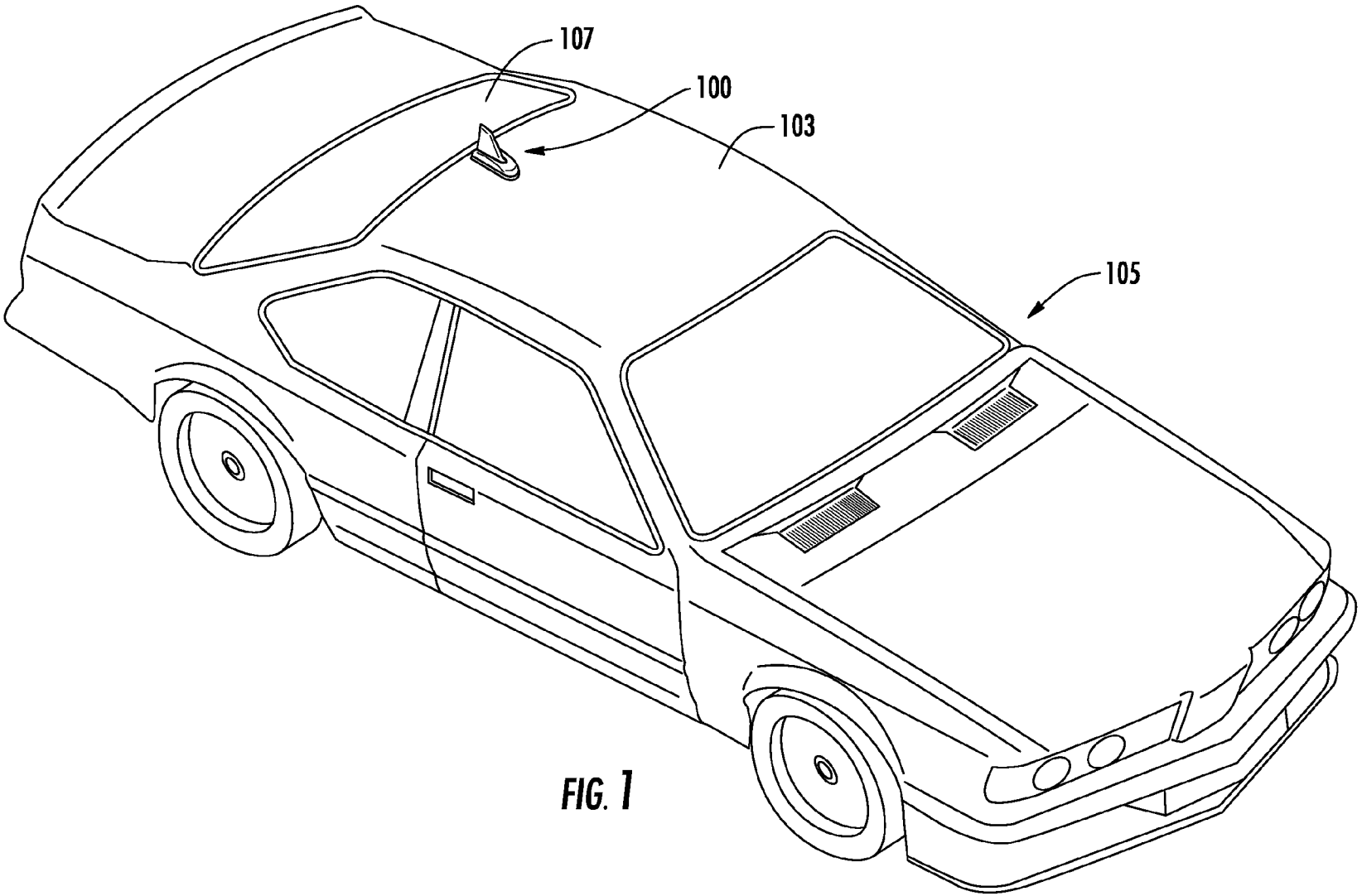
FIG. 1 is a perspective view of an antenna assembly according to one example embodiment of the present disclosure, with the antenna assembly shown installed to a roof of an automobile.
Figure 2:
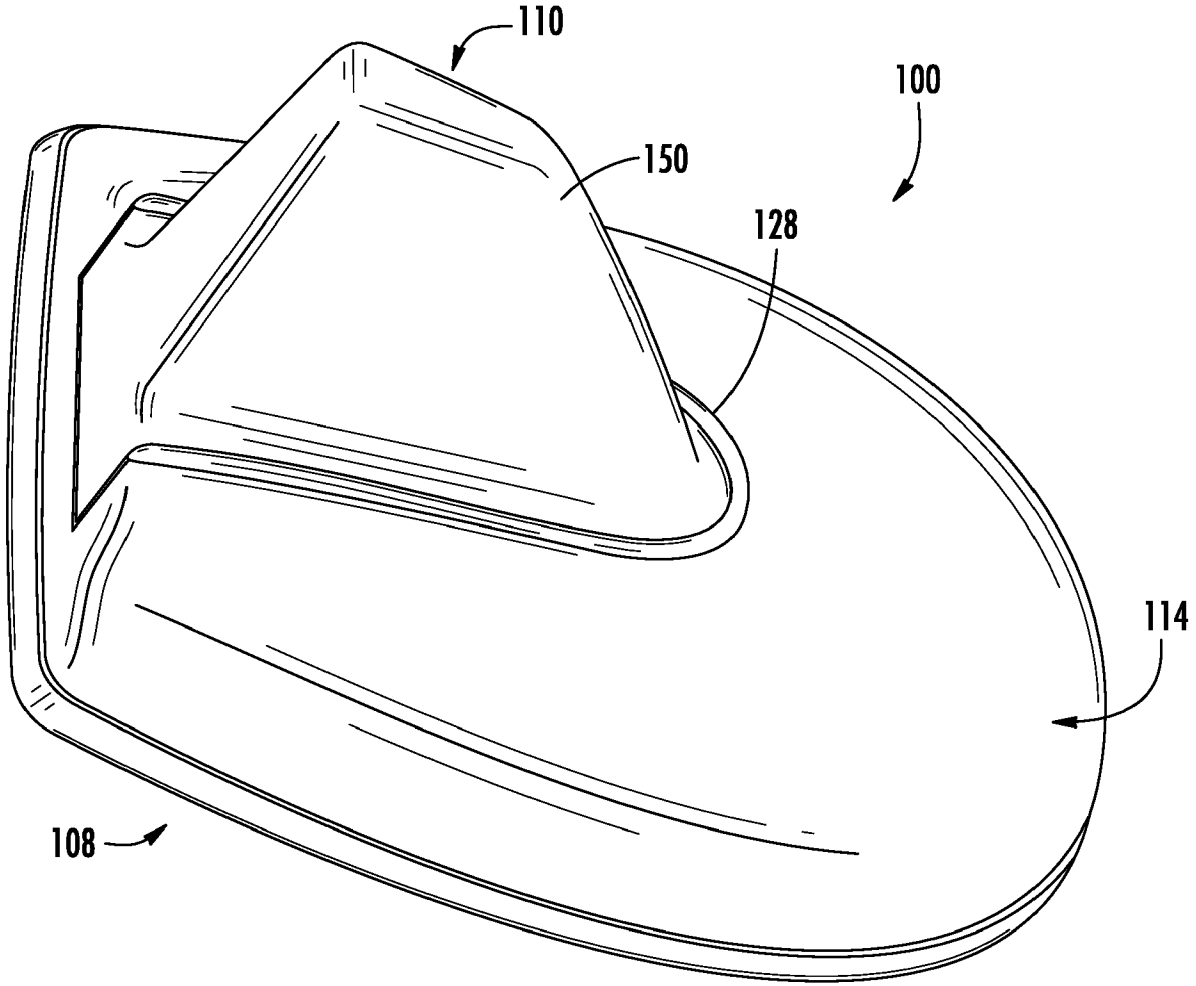
FIG. 2 is an enlarged upper perspective view of the antenna assembly of FIG. 1.
Figure 3:
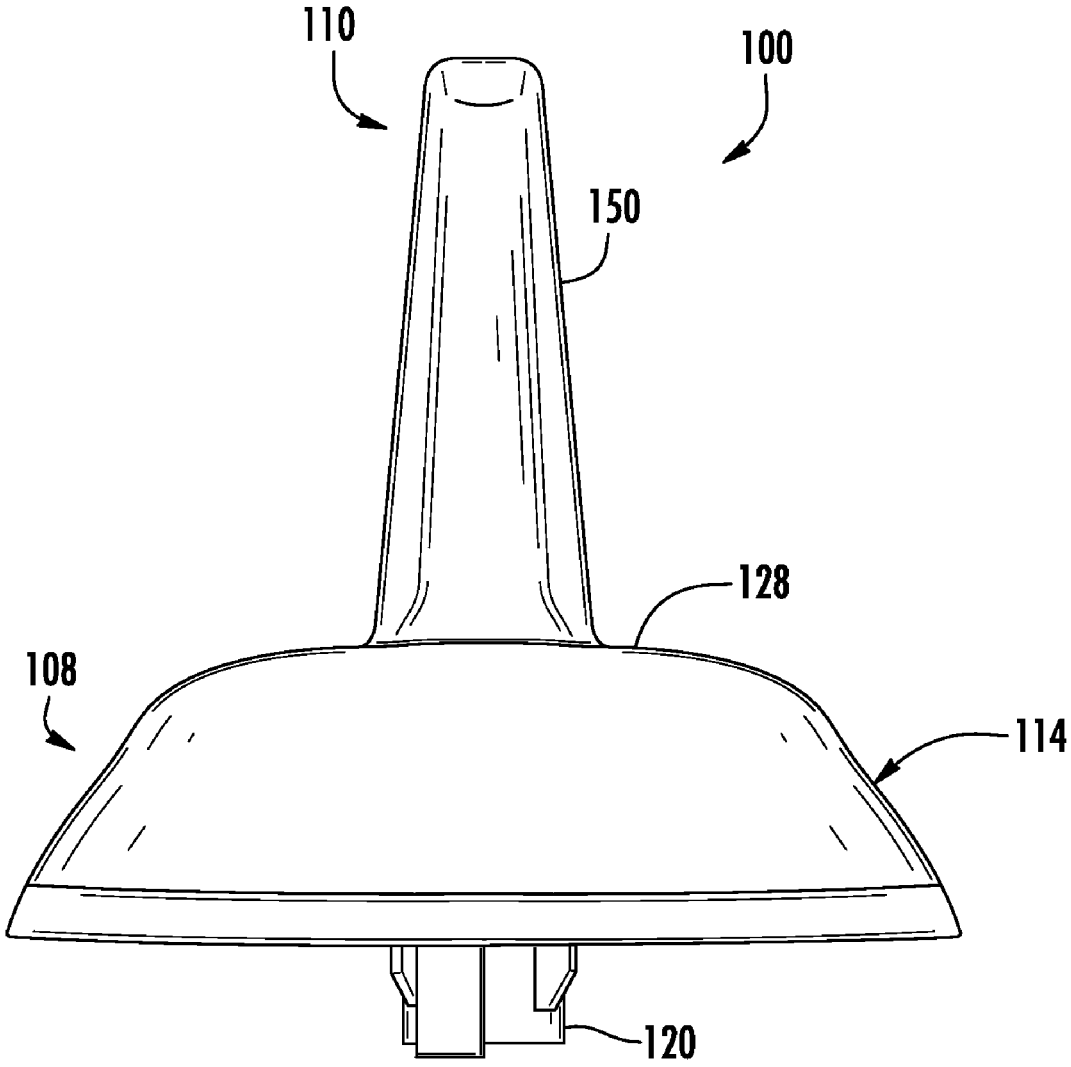
FIG. 3 is a front elevation view of the antenna assembly of FIG. 2.
Figure 4:
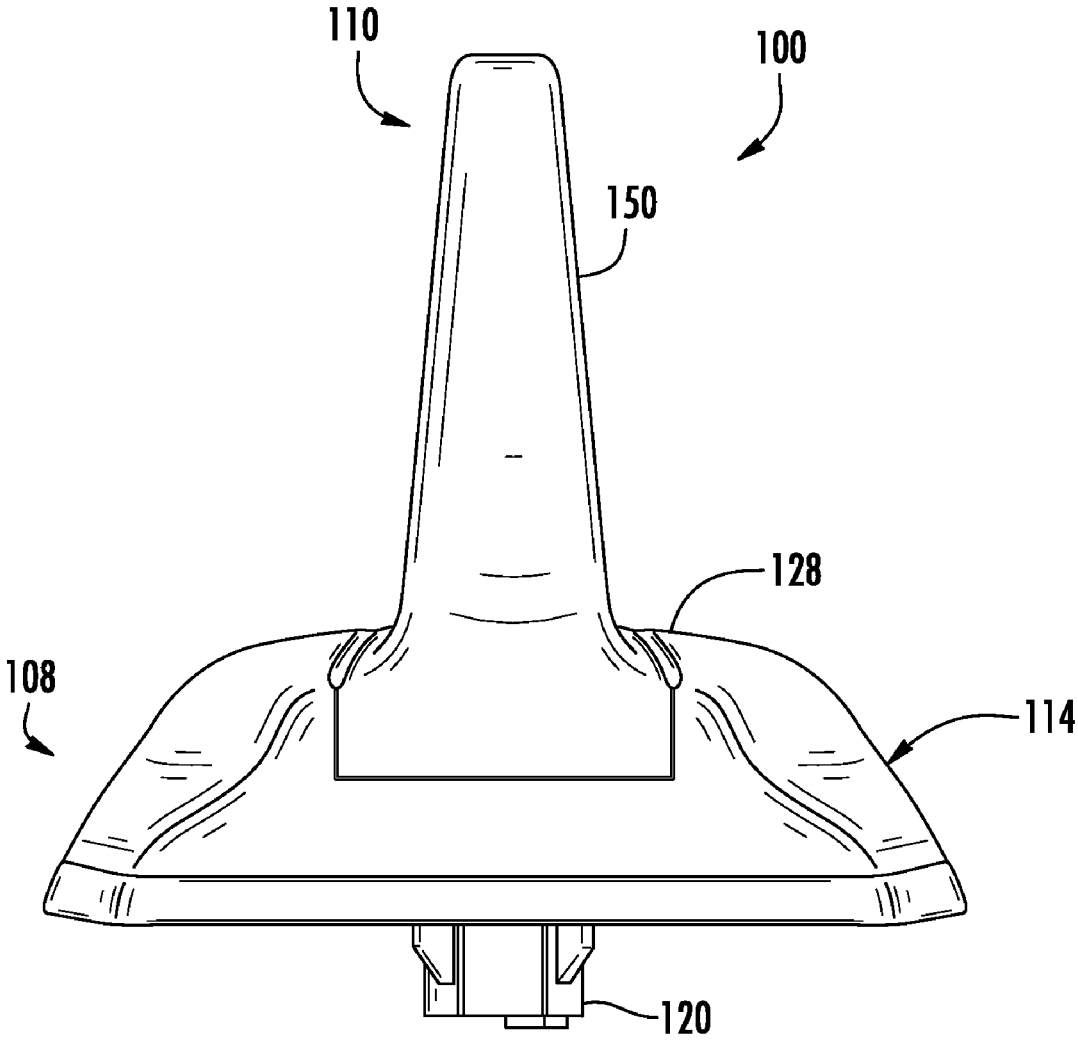
FIG. 4 is a rear elevation view of the antenna assembly of FIG. 2.
Figure 5:
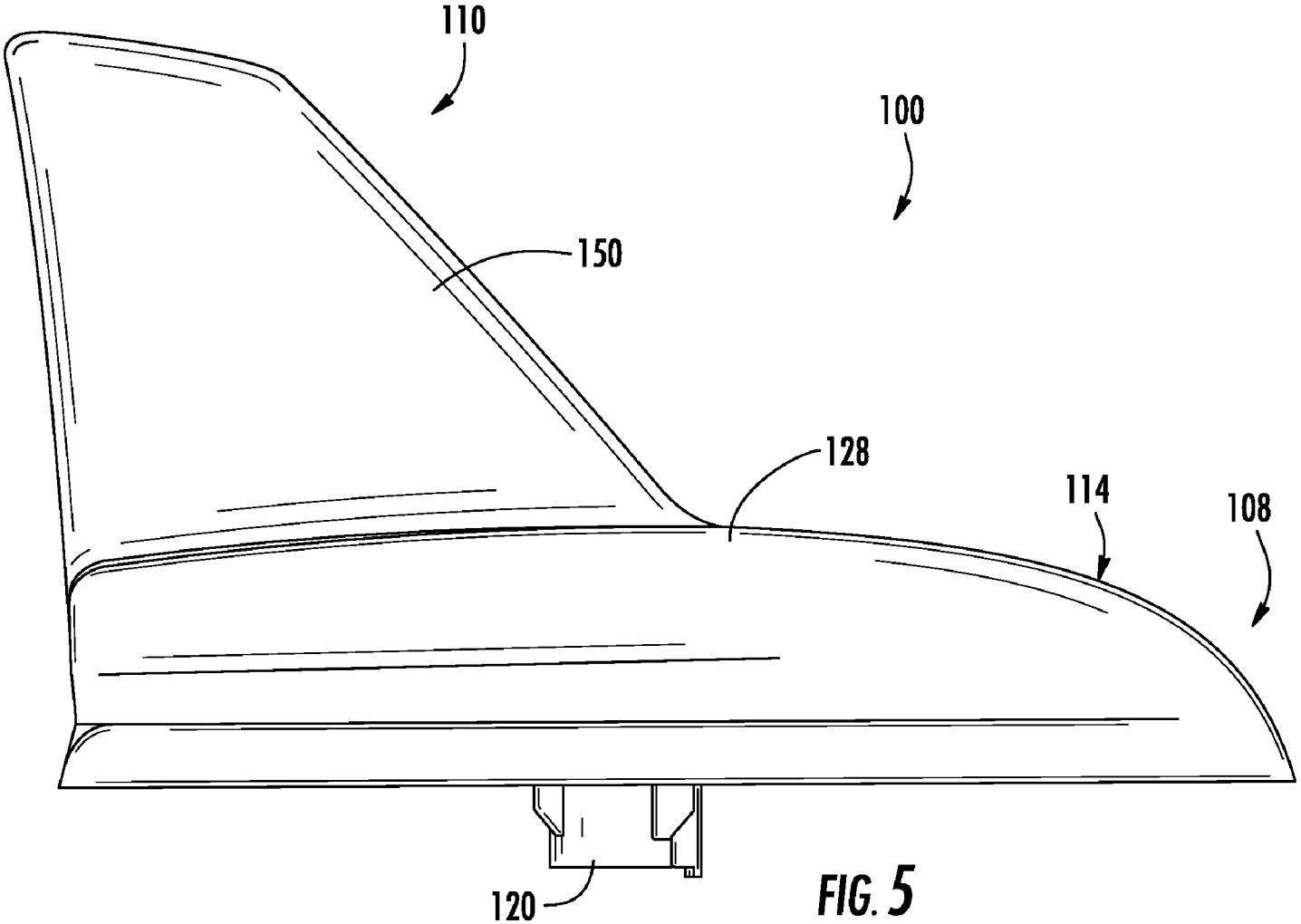
FIG. 5 is a left side elevation view of the antenna assembly of FIG. 2.
Figure 6:
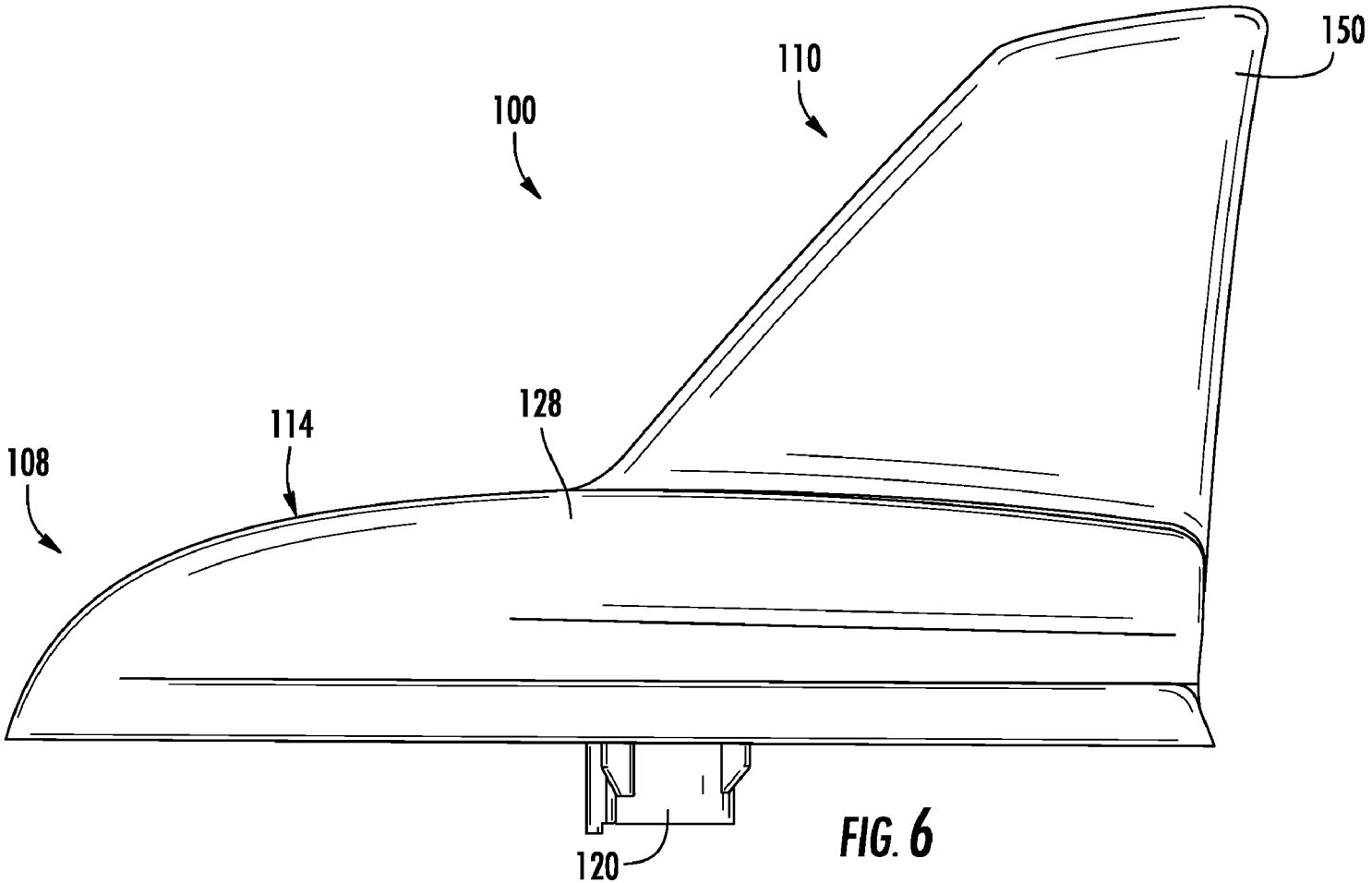
FIG. 6 is a right side elevation view of the antenna assembly of FIG. 2.
Figure 7:
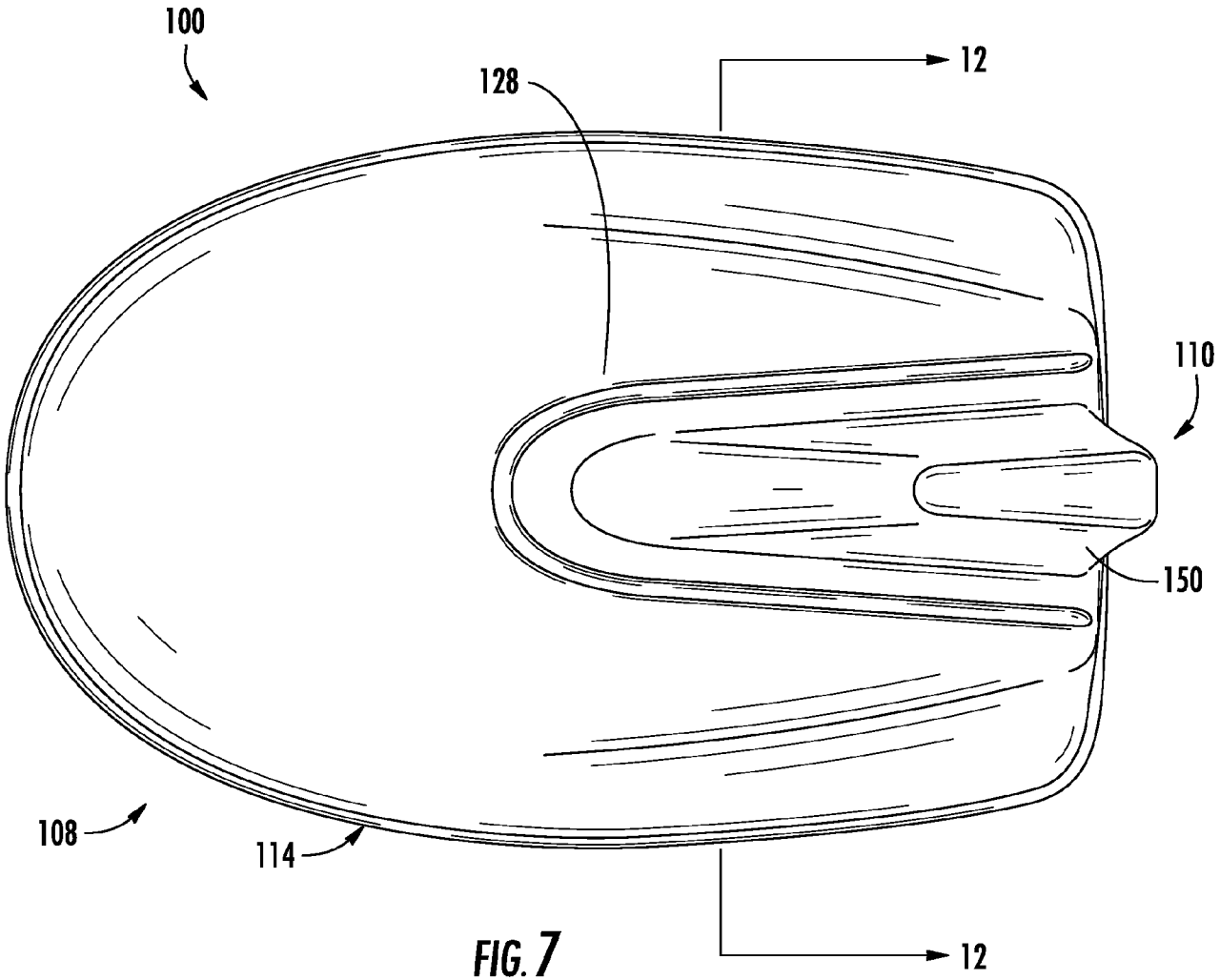
FIG. 7 is a top plan view of the antenna assembly of FIG. 2.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

At an assembly plant at which antenna assemblies are installed to vehicles (e.g., automobiles, etc.), it is not uncommon for there to be available to the installers a wide variety of different configurations of antenna assemblies for installation to different surfaces (e.g., hoods, roofs, trucks, etc.) of the vehicles. For example, an antenna assembly (or more specifically, a base portion of the antenna assembly) may be shaped to match a contour of a specific vehicle body surface on which it will be mounted. Each base portion of each antenna assembly is usually uniquely designed for mounting on a specific vehicle and/or specific vehicle surface. Consequently, an antenna assembly designed for one vehicle and/or one vehicle surface typically will not be acceptable for mounting on a different vehicle and/or on a differently contoured vehicle surface. Having such uniquely designed antenna assemblies for each vehicle and/or vehicle surface can increase design complexity, manufacturing complexity, inventory complexity, and can make the installer's job more difficult.

The inventors hereof have also recognized the following issues often related to installation of an antenna assembly to a given intended vehicle and/or vehicle surface. A wide variety of antenna element types (e.g., single band antenna elements, dual band antenna elements, tri-band antenna elements, multiband antenna elements, antenna elements configured for use with one or more of AMPS, GSM 850, GSM 900, GSM 1800, PCS, GSM 1900, and/or UMTS systems, etc.) are available to accommodate customer preferences. The various antenna element types, however, may be designed, developed, and/or built by different antenna manufacturers, who then ship the antenna elements to the assembly plant for installation. In such cases, the antenna elements from one manufacturer may require a different installation and/or mounting method than the antenna elements of another manufacturer. Consequently, installers would have to be familiar with the different mounting methods required for the antenna elements from the different manufacturers. In addition, having different antenna elements from different manufacturers can also increase inventory complexity and cost, and can make the installers' job more difficult as the installers would not only have to select the correct antenna base portion for the given intended vehicle and/or vehicle surface, but would also have to select a particular antenna element type to install to the vehicle based on customer preferences.

In view of their recognition of the above, the inventors hereof have developed various example embodiments of antenna assemblies in which universal, common, etc. antenna base portions may be used with any one of a plurality of interchangeable antenna modules, having, for example, one or more of a plurality of different antenna element types. For ease of assembly and/or interchangeability, the antenna modules may be slidably mountable to the universal base portions. Such example antenna assemblies may allow an installer to select a particular antenna module (e.g., from a storage of different antenna modules, etc.) configured for operation consistent with a customer's preference, and then slidably mount the selected antenna module to a universal base portion already on a vehicle. This may be done at a manufacturing plant, at a dealership, aftermarket, etc. And the antenna module may have a printed circuit board and one or more antenna elements, such as one or more vertically extending antenna masts, one or more patch antennas, one or more radiating antenna elements (e.g., traces) on the printed circuit board, one or more planar inverted F-antenna (PIFA) elements, etc. disposed within an outer cover (e.g., a fin-shaped cover, etc.).

Utilizing a universal base portion with interchangeable antenna modules may also help simplify the installation process for installers, as the installers would only need to know, learn, etc. how to install the universal base portion to a vehicle and/or vehicle surface, and not different base portions from different manufacturers. In addition, utilizing a universal base portion with interchangeable antenna modules may allow for holding a less costly inventory. For example, maintaining an inventory of a plurality of desired different antenna assemblies (e.g., a plurality of different base portions and their corresponding antenna elements, etc.) would not be necessary. Instead, it may be sufficient to maintain an inventory of a sufficient number of universal base portions, and a sufficient inventory of each typically desired antenna module.

In various example embodiments, antenna assemblies generally include base portions (e.g., mounting portions, chassis, bases, covers, or other components of antenna assemblies, etc.) and antenna modules (e.g., antenna subassemblies having printed circuit boards and antenna elements, etc.) that may be slidably coupled to the base portions. In some example embodiments, the antenna assemblies may be configured (e.g., sized, shaped, constructed, etc.) such that antenna modules may be relatively easily coupled, installed, mounted, assembled, engaged, etc. to base portions of the antenna assemblies.

In some example embodiments, the antenna assemblies may include antenna modules having track components and base portions (e.g., mounting bases, chassis, etc.) having corresponding track components such that the antenna modules may be slidably coupled to the base portions via the track components. The antenna modules' track components may include protrusions, extensions, etc.; and the base portions' track components may include apertures, openings, slots, channels, etc. defined therein. And the antenna modules' track components may be configured (e.g., sized, shaped, constructed, etc.) to be slidably received within the corresponding base portions' track components. For example, the corresponding track structures may allow for slidably coupling different antenna modules to universal base portions.

In some example embodiments, the antenna assemblies may include antenna modules that can be coupled to base portions such that there is a general reduction in height dimensions measured from distal ends of the antenna modules to vehicle surfaces to which the antenna assemblies are mounted. In such example embodiments, the antenna modules may be slidably coupled to the base portions in a manner that achieves reduced antenna assembly profiles when mounted to vehicles and/or reduced overall antenna assembly heights above vehicle surfaces on which the antenna assemblies are mounted.

In some example embodiments, the antenna assemblies may include antenna modules and base portions configured (e.g., sized, shaped, constructed, etc.) to releasably interlock when coupled together to help ensure that the antenna modules do not uncouple from the base portions. For example, the base portions may include stops, retaining members, etc. that releasably engage with retaining clips, tabs, members, etc. of the antenna modules to help inhibit undesired movement of the antenna modules away from, off of, etc. the base portions.

With reference now to the drawings, FIGS. 1 through 12 illustrate an example embodiment of an antenna assembly 100 including one or more aspects of the present disclosure. As shown in FIG. 1, the antenna assembly 100 may be installed to a mobile platform such as a roof 103 of an automobile 105. In FIG. 1, for example, the antenna assembly 100 is installed generally along a longitudinal centerline of the roof 103 and toward a rear window 107 of the automobile 105. The antenna assembly 100 could be installed at different locations on the roof 103 (e.g., askew of the longitudinal centerline, etc.) within the scope of the present disclosure. And in other example embodiments, antenna assemblies may be installed to other mobile platforms, such as hoods, trunks, other vehicle body walls (or surfaces), etc. of automobiles, busses, trucks, boats, other vehicles, etc.

As shown in FIGS. 2 through 7, the antenna assembly 100 generally includes a chassis 108 (broadly, a base portion) and an antenna module 110 supported by the chassis 108. The chassis 108 is configured (e.g., sized, shaped, constructed, etc.) to be coupled to a vehicle body wall, such as the roof 103 of the automobile 105 in FIG. 1. And the antenna module 110 is configured (e.g., sized, shaped, constructed, etc.) to be coupled (e.g., slidably, etc.) to the chassis 108 (as will be described in further detail hereinafter) in a position generally above the chassis 108 and, for example, generally over the roof 103 of the automobile 105 (e.g., as shown in FIG. 1, etc.). The illustrated chassis 108 includes a generally flat profile, and the illustrated antenna module 110 includes a generally thin and tall construction. Thus, when the antenna module 110 is coupled to the chassis 108, they define, for example, a generally fin-shape antenna assembly 100. This generally fin-shape of the antenna assembly 100 may provide an aesthetically pleasing appearance to the antenna assembly 100 as well as a generally aerodynamic configuration (e.g., size, shape, construction, etc.). It should be understood, however, that the present disclosure is not limited to chassis and antenna modules defining fin-shape antenna assemblies; chassis and antenna modules may define antenna assemblies having shapes other than fin shapes within the scope of the present disclosure.

Figure 8:
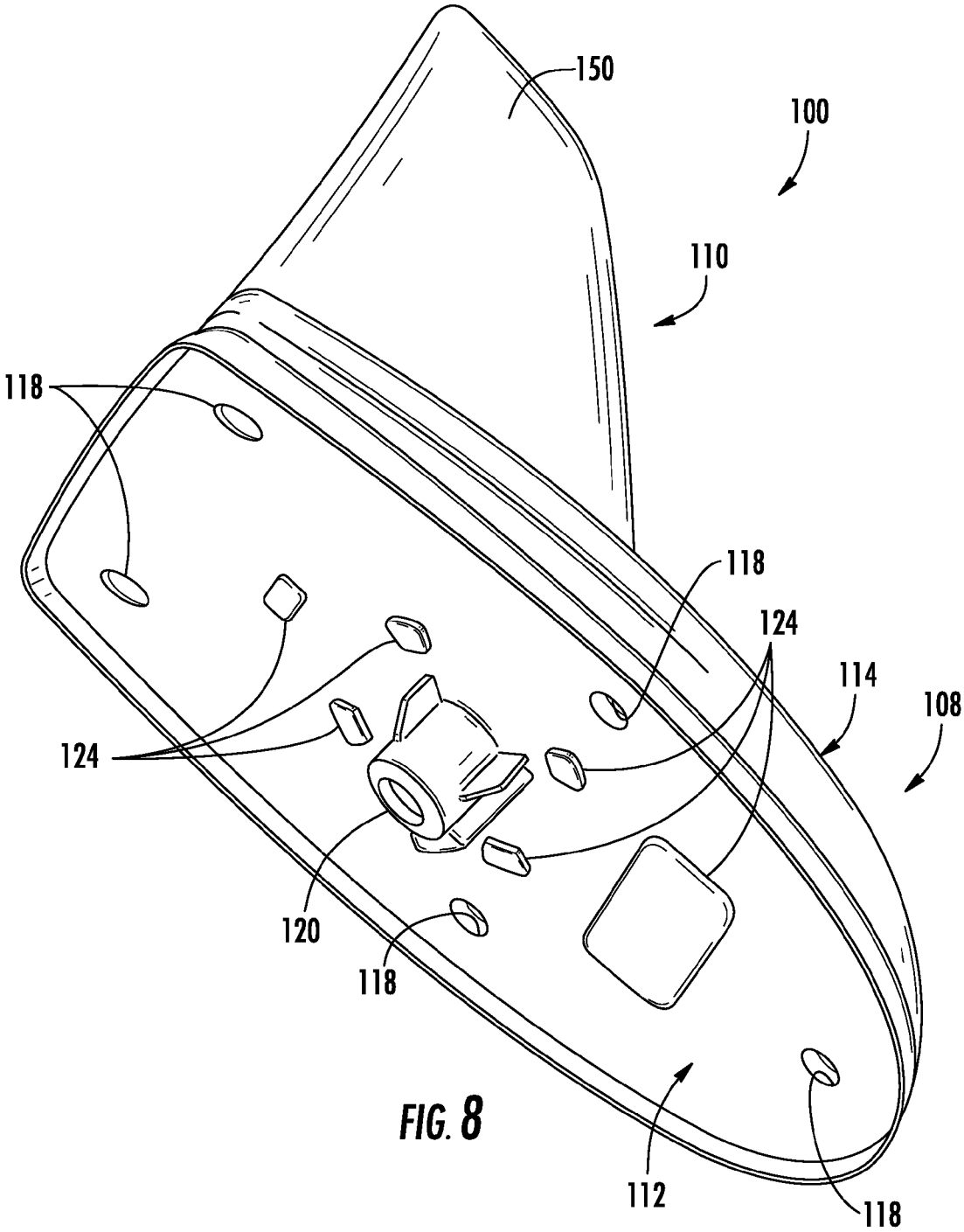
FIG. 8 is a lower perspective view of the antenna assembly of FIG. 2.
Figure 9:
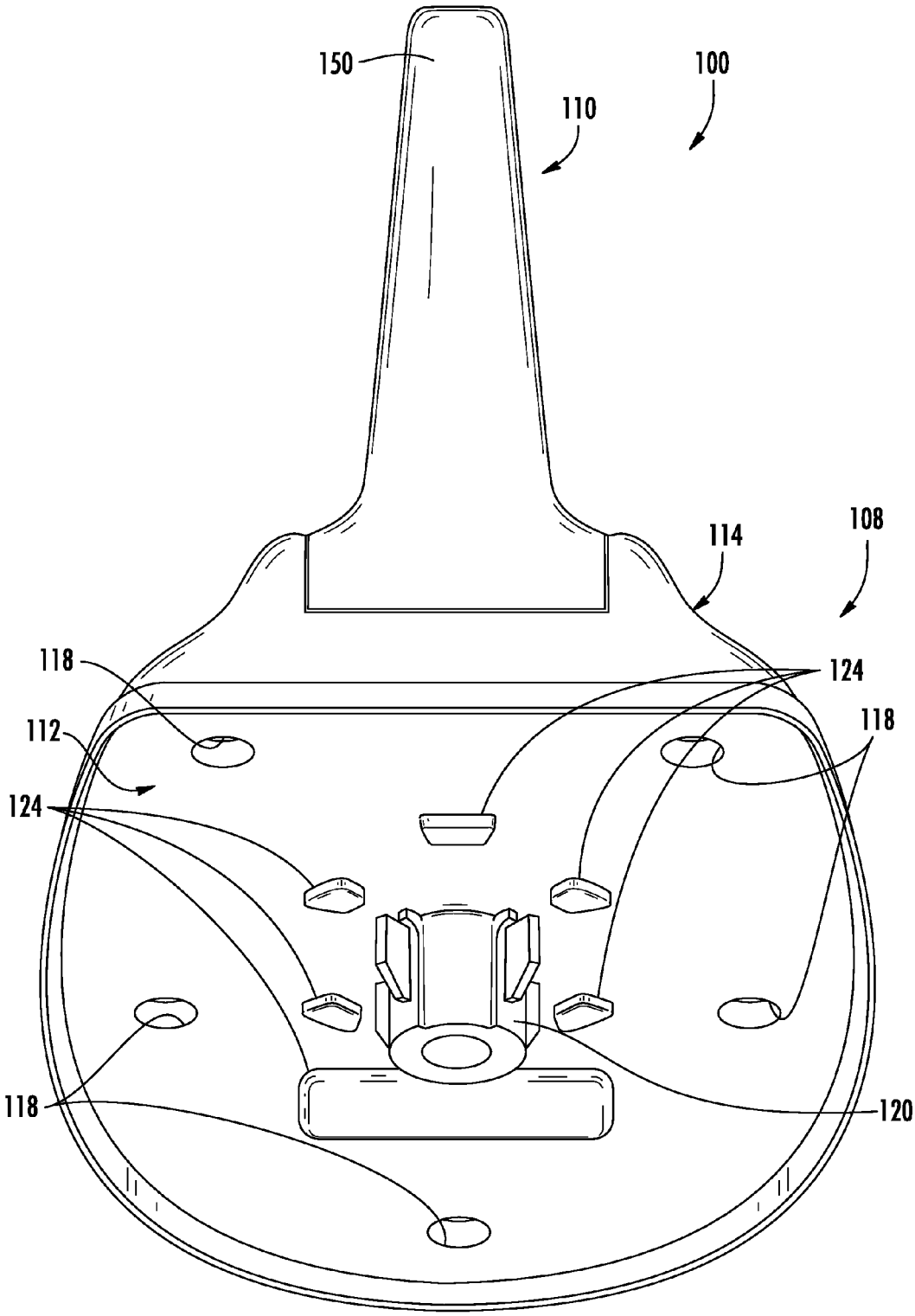
FIG. 9 is a lower perspective view similar to FIG. 8, with the antenna assembly rotated rearwardly.
Figure 10:
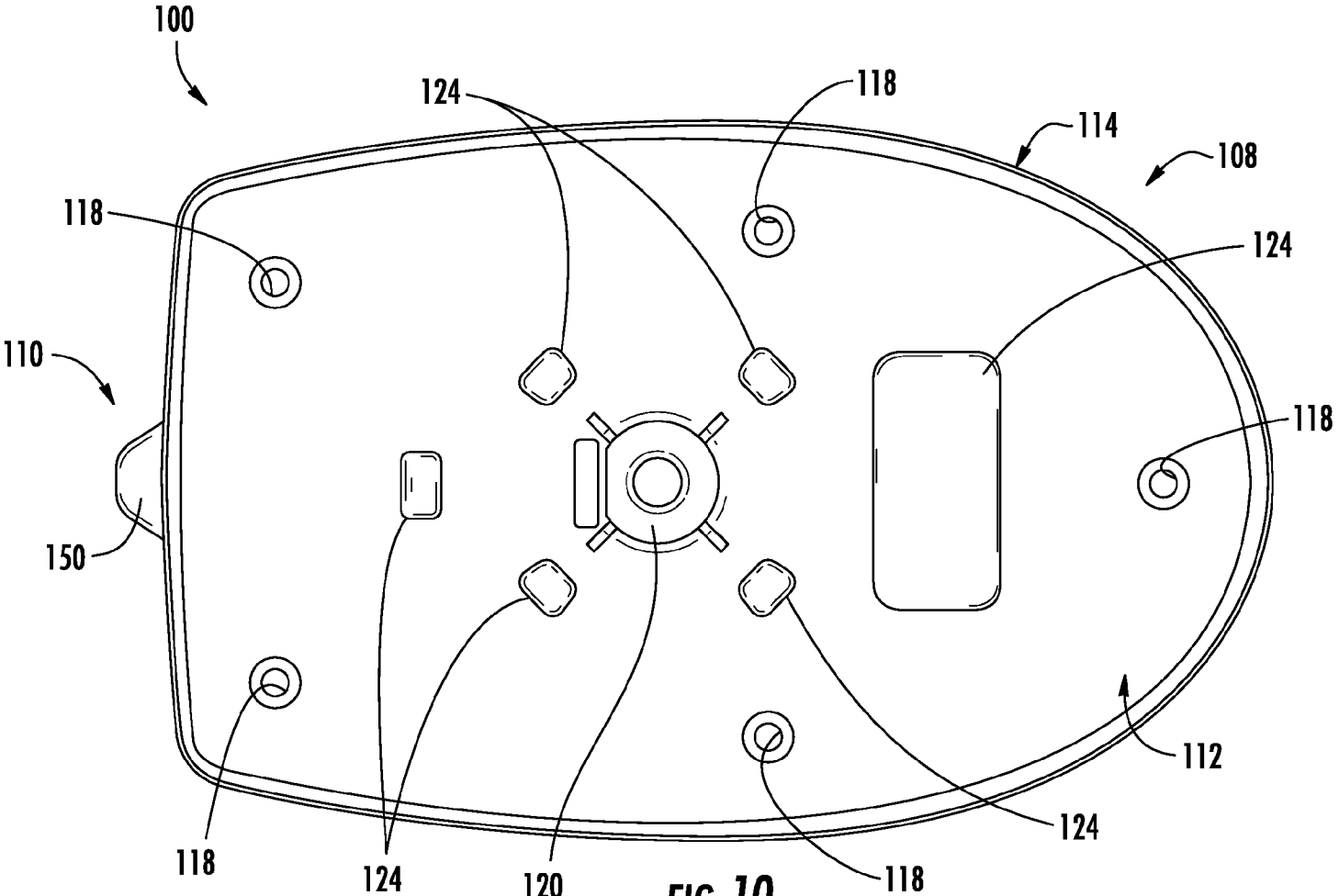
FIG. 10 is a bottom plan view of the antenna assembly of FIG. 2.

With additional reference now to FIGS. 8 through 10, the chassis 108 of the antenna assembly 100 includes a generally flat and thin base plate 112 (broadly, a support member) and an outer, generally concave cover 114 coupled to the base plate 112. The base plate 112 is positioned generally below the cover 114 such that the cover 114 generally fits over and covers the base plate 112. The base plate 112 and the cover 114 may be coupled together by suitable means, for example, a snap-fit connection, mechanical fasteners (e.g., screws, other fastening devices, etc.), ultrasonic welding, solvent welding, heat staking, adhesives, latching, bayonet connections, hook connections, integrated fastening features, etc. within the scope of the present disclosure. And a sealing member (e.g., an O-ring, a resiliently compressible elastomeric material or foam gasket, etc.) (not shown) may be provided between the cover 114 and the base plate 112 for substantially sealing the cover 114 against the base plate 112. Thus, the cover 114 can be securely coupled to the base plate 112 so as to help protect components of the chassis 108 against ingress of contaminants (e.g., dust, moisture, etc.) into an interior enclosure of the chassis 108 defined between the cover 114 and the base plate 112.

The base plate 112 of the chassis 108 (and thus the antenna assembly 100) may be coupled to the roof 103 of the automobile 105 by fasteners (not shown) positioned through, for example, openings 118 in the base plate 112 and through corresponding openings (not shown) in the roof 103. Alternatively, the base plate 112 may be coupled to the automobile's roof 103 by, for example, adhesives, welds, compression fasteners, etc. within the scope of the present disclosure.

The base plate 112 includes a guide 120 extending generally downwardly from a lower surface of the base plate 112. The guide 120 may be positioned within an opening (not shown) in the automobile's roof 103 (e.g., when the base plate 112 is coupled to the roof 103, etc.) for helping properly locate the base plate 112 on the roof 103. The guide 120 may also allow for a suitable communication link (e.g., a coaxial cable, etc.) (not shown) to extend through the guide 120 and into the automobile 105 for electrically coupling the antenna assembly 100 (e.g., a printed circuit board (PCB) 122 (FIG. 12) within the antenna assembly 100, etc.) to the automobile 105. Pads 124 are positioned along the lower surface of the base plate 112, for example, to couple the chassis ground to roof ground for optimal or better antenna performance.

Figure 11:
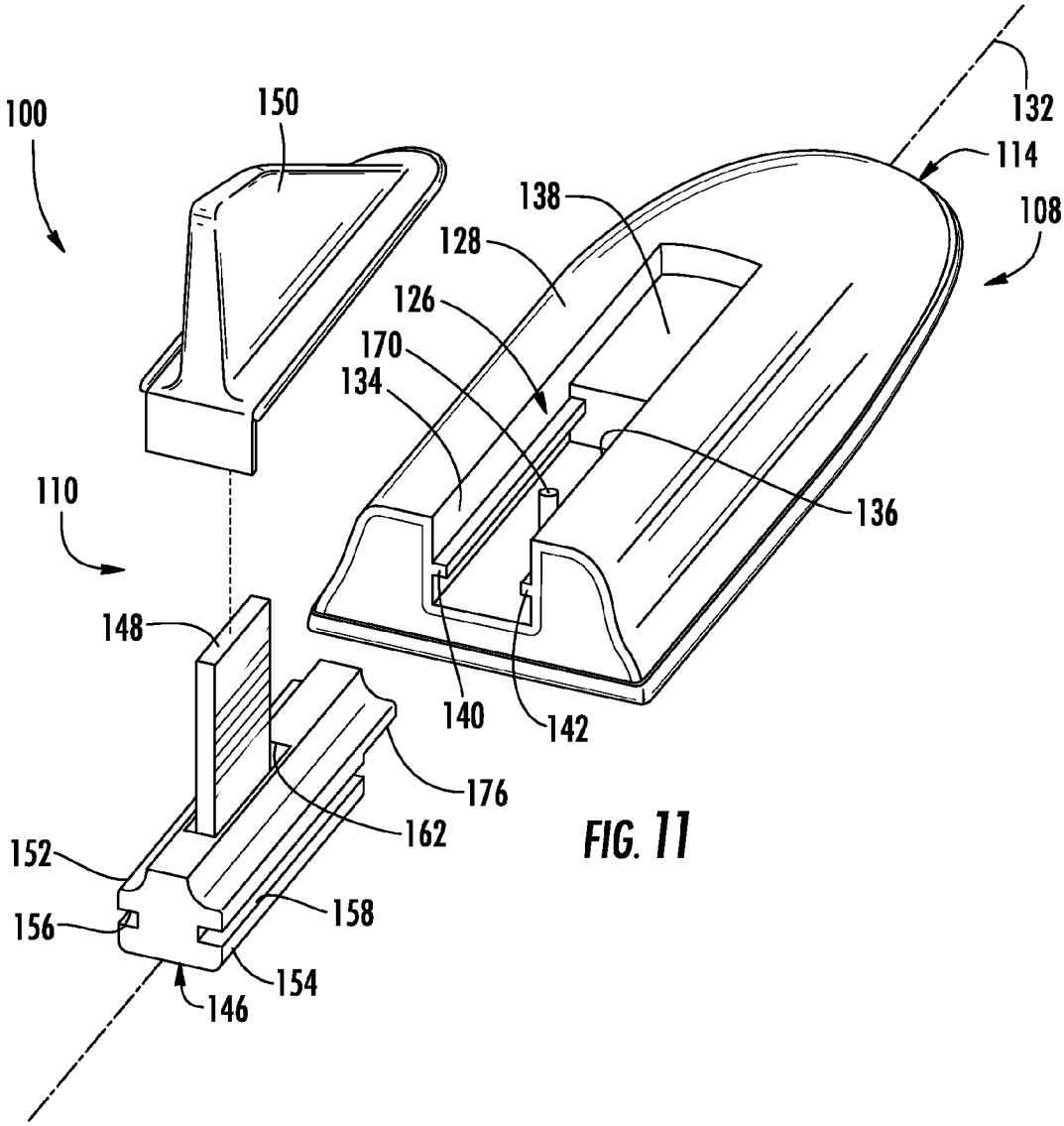
FIG. 11 is an exploded perspective view of the antenna assembly of FIG. 2, with an antenna module of the antenna assembly positioned rearwardly of a mounting base and with a cover of the antenna module removed.

As shown in FIG. 11, the cover 114 of the chassis 108 defines a channel 126 extending generally longitudinally along an upper portion 128 of the cover 114 (at least partially along longitudinal axis 132). The channel 126 includes side surfaces 134 and 136 extending generally longitudinally along the channel 126, and a plateau 138 defined generally forwardly of the channel 126. The side surfaces of the channel 126 each include a projecting portion 140 and 142 (respectively). The first projecting portion 140 depends generally inwardly from the first side surface 134, and the second projecting portion 142 depends generally inwardly from the second side surface 136. Projecting portions may include, for example, tenons, tongues, sliding engagement members, etc. of various sizes and shapes, for example, triangular, rectangular, hemi-spherical, etc. within the scope of the present disclosure.

With continued reference to FIG. 11, the antenna module generally includes a rail mount 146, an antenna element 148 (e.g., a stamped metal antenna, etc.) supported generally above the rail mount 146, and an outer cover 150 configured (e.g., sized, shaped, constructed, etc.) to fit over the antenna element 148 and rail mount 146. The illustrated rail mount 146 is generally elongate in shape and includes first and second lateral side portions 152 and 154. A first longitudinal slot 156 is defined generally along the first lateral side portion 152, and a second longitudinal slot 158 is defined generally along the second lateral side portion 154. With this construction, the illustrated rail mount 146 includes a cross-section shape generally corresponding to a capital English letter I, and thus may be considered as generally defining an I-type rail mount 146 (also see, e.g., FIG. 12, etc.).

The antenna element 148 is supported by the rail mount 146 generally within an opening 162 extending through the rail mount 146. For example, the rail mount 146 may include a support member (not shown) within the opening 162 that is configured (e.g., sized, shaped, constructed, etc.) to be received within a corresponding aperture (not shown) of the antenna element 148 for coupling the antenna element 148 to the rail mount 146. The cover 150 is positioned over the antenna element 148 and over at least part of the rail mount 146, and can be coupled to the rail mount 146 by suitable means, for example, a snap-fit connection, an epoxy connection, a weld connection, etc. within the scope of the present disclosure. A sealing member (e.g., an O-ring, a resiliently compressible elastomeric material or foam gasket, etc.) (not shown) may be provided between the cover 150 and the rail mount 146 for substantially sealing the cover 150 against the rail mount 146. Thus, the cover 150 may be securely coupled to the rail mount 146, for example, to help protect the antenna element 148 against ingress of contaminants (e.g., dust, moisture, etc.) into an interior enclosure generally defined by the cover 150 and the rail mount 146.

The illustrated antenna element 148 includes a stamped metal monopole antenna element 148. The stamped metal monopole antenna element 148 is relatively thin and generally planar, and includes, for example, a conductor portion (also, radiating element, etc.) tuned to receive electrical resonance frequencies over a given bandwidth, for example, a bandwidth ranging from about 800 MHz to about 1000 MHz, and a bandwidth ranging from about 1650 MHz to about 2700 MHz, etc.

Figure 12:
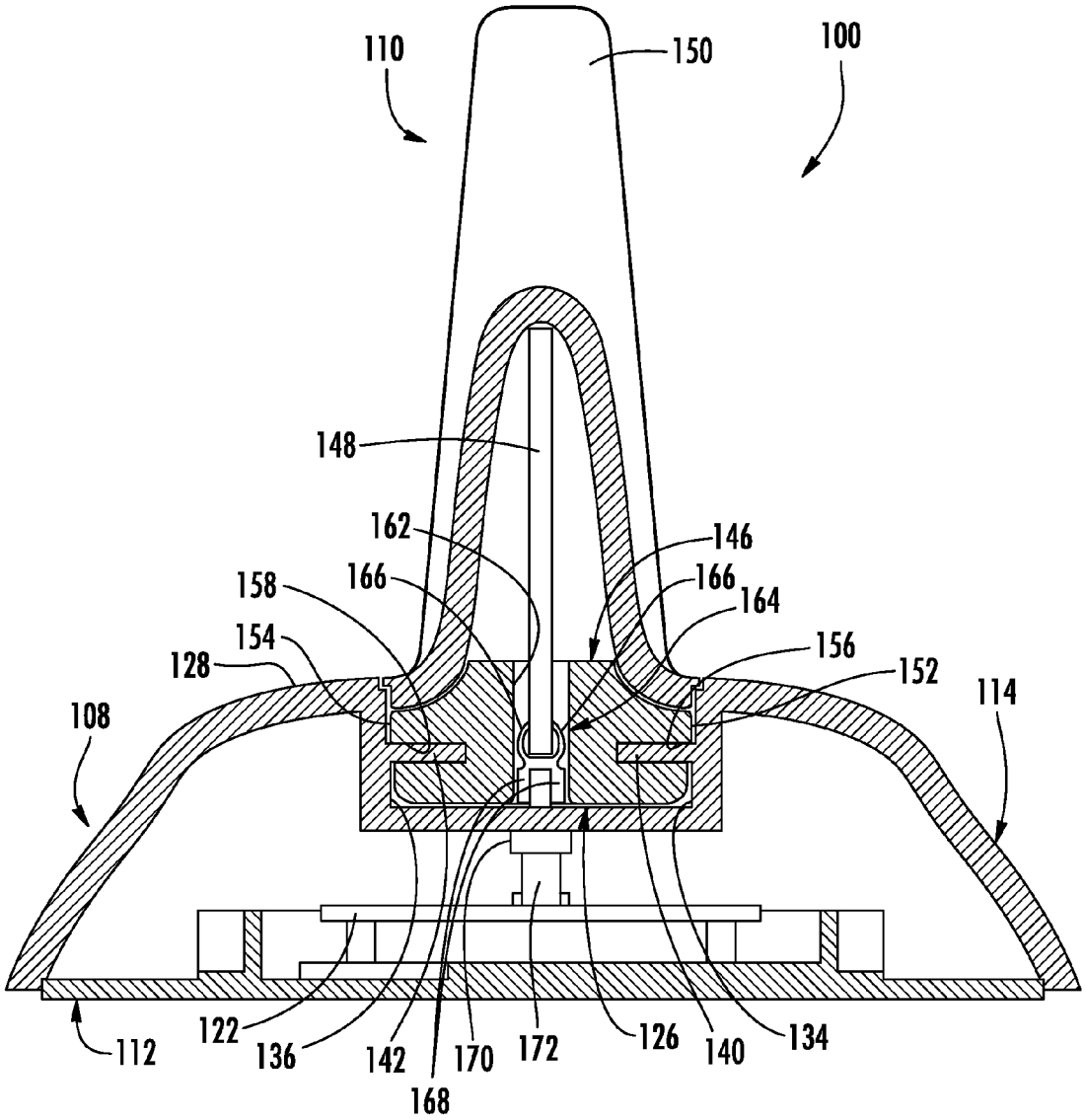
FIG. 12 is a section view of the antenna assembly taken in a plane including line 12-12 in FIG. 7.

Referring now to FIG. 12, a spring clip 164 is coupled to a lower edge portion of the antenna element 148 generally within the rail mount's opening 162, for example, for use in electrically coupling the antenna element 148 to the chassis 108 when the antenna module 110 is positioned in the chassis 108 (as will be described in further detail hereinafter). The spring clip 164 includes a pair of opposing, resilient arms (each indicated at 166) and a pair of opposing, resilient legs (each indicated at 168) extending generally downwardly from the arms 166. The arms 166 are configured (e.g., sized, shaped, constructed, etc.) to receive the antenna element 148 between the arms 166 to help securely couple the spring clip 164 to the antenna element 148, and the legs 168 are configured (e.g., sized, shaped, constructed, etc.) to receive a connector 170 of the chassis 108 between the legs 168 to help securely couple the spring clip 164 to the connector 170 (as will be described in more detail hereinafter). The arms 166 and legs 168 of the spring clip 164 may be constructed from a conducting material, such as a metallic material, so as to create electrical contact between the antenna assembly 100 and the spring clip 164.

As also shown in FIG. 12, the connector 170 is located within the channel 126 of the chassis 108 (FIG. 11) and is coupled to the PCB 122 located within the chassis 108. The PCB 122 is mounted within the chassis 108 on an upper surface of the base plate 112, generally between the base plate 112 and the chassis's cover 114. A link 172 extends upwardly from the PCB 122 and resiliently engages the connector 170 for electrically coupling the antenna element 148 and the PCB 122. In the illustrated embodiment, for example, the link 172 includes a leaf-spring structure. The link 172 and connector 170 may be constructed from a conducting material so as to create electrical contact between the antenna element 148, and the PCB 122. The link 172 and connector 170 may also be constructed as one piece of flexible conductive material, such as a conductive silicone, or a conductive polymer, etc., so as to create electrical contact between the antenna element 148, and the PCB 122. The PCB 122 may receive signal input from the antenna element 148, process the signal input, and/or transmit the processed signal input to a suitable communication link as desired. Alternatively, or in addition, the PCB 122 may process signal input to be transmitted via or through the antenna element 148.

With continued reference to FIG. 12, the antenna module 110 can be coupled to the chassis 108 by positioning (e.g., sliding, etc.) the rail mount 146 of the antenna module 110 into the channel 126 of the chassis 108. For example, the rail mount 146 can initially be aligned with the channel 126 of the chassis 108 such that the first and second projecting portions 140 and 142 of the channel 126 are generally aligned with the corresponding first and second longitudinal slots 156 and 158 of the rail mount 146 and the connector 170 positioned within the channel 126 is generally aligned with the rail mount's opening 162. The rail mount 146 (and thus the antenna module 110) can then be moved longitudinally (e.g., slid longitudinally, etc.) into the channel 126 with the projecting portions 140 and 142 of the channel 126 received into (and moved generally through) the corresponding first and second longitudinal slots 156 and 158 of the rail mount 146. And the connector 170 can be received into a slotted portion (not visible) of the rail mount's opening 162 that extends longitudinally along the lower surface of the rail mount 146 from about the antenna element 148 to an opening (not visible) generally under a forward lip 176 of the rail mount 146.

When the rail mount 146 is fully positioned within the chassis's channel 126, the forward lip 176 of the rail mount 146 is located generally over the forward plateau 138 of the channel 126, a lower surface of the rail mount 146 is located generally adjacent the upper surface of the channel 126, and a rearward surface of the rail mount 146 is generally flush with a rearward surface of the chassis's cover 114. And the connector 170 is positioned within the opening 162 of the rail mount 146 generally between the resilient legs 168 of the spring clip 164 and thus in electrical contact with the spring clip 164 (and the antenna element 148). In this position, the antenna module 110 may be frictionally retained on the chassis 108 (e.g., by the projecting portions 140 and 142 of the channel 126 received into the corresponding first and second longitudinal slots 156 and 158 of the rail mount 146; by the connector 170 positioned generally between the resilient legs 168 of the spring clip 164; etc.) against forces (e.g., wind forces, etc.) tending to move the antenna module 110 rearwardly and off the chassis 108. Alternate designs may include snap-fins, fasteners, adhesive, etc. to retain the antenna module 110 onto the chassis 108.

If desired, the antenna module 110 can subsequently be removed from the chassis 108, for example, for maintenance, repair, replacement, etc. For example, a user can apply sufficient force to the antenna module 110 to overcome the frictional forces retaining the rail mount 146 in the channel 126 and move (e.g., slide, etc.) the rail mount 146 out of the chassis's channel 126. Desired maintenance, repair, etc. can be performed on the antenna module 110, and the antenna module 110 can then again be moved back into the chassis 108. Alternatively, a different (e.g., replacement, etc.) antenna module could be moved into the chassis 108. Thus, it can be seen that the chassis 108 may be configured to interchangeably receive various different antenna modules that include, for example, a rail mount (e.g., 146, etc.) configured (e.g., sized, shaped, constructed, etc.) to be slidably engaged, received, into a channel (e.g., 126, etc.) of the chassis 108.

The legs 168 of the spring clip 164 in the illustrated antenna module 110 are configured (e.g., sized, shaped, constructed, etc.) to resiliently deform (e.g., move apart, etc.) when the rail mount 146 moves into the channel 126 and the spring clip's legs 168 engage the connector 170. This allows the legs 168 to move generally around the connector 170 to securely receive the connector 170 between the legs 168 (and in electrical contact with the antenna element 148). The resilient nature of the spring clip's legs 168 also allows the legs 168 to release the connector 170 (e.g., when desired to remove the antenna module 110 from the chassis 108, etc.), and, for example, subsequently receive another connector between the legs 168 (e.g., when desired to position another antenna module in the chassis 108, etc.) and in electrical contact with an antenna element of the subsequent antenna module. Thus, the resilient legs 168 of the spring clip 164 may help accommodate repeated coupling and removal of one or more antenna modules with the chassis 108.

In the illustrated embodiment, the rail mount 146 of the antenna module 110 includes an I-type rail mount 146 (e.g., having a cross-sectional shape or profile corresponding to the shape of a capital letter I of the English alphabet). The I-type rail mount 146 may allow for a stronger coupling between the antenna module 110 and the chassis 108. For example, the I-type structure of the rail mount 146 may help improve resistance of the antenna module 110 to forces (e.g., wind forces, etc.) applied to the antenna module 110 (e.g., to sides of the cover of the antenna module 110, etc.) during use of the antenna assembly 100 with a mobile platform (e.g., when installed to the automobile 105, etc.). The I-type rail mount 146 may also provide a lower connection point between the antenna module 110 and the chassis 108 as compared to other example antenna assemblies. For example, the first and second projecting portions 140 and 142 of the channel 126 and the corresponding first and second longitudinal slots 156 and 158 of the rail mount 146 coupling the antenna module 110 to the chassis 108 are both located generally within the chassis's cover (and below an upper surface (e.g., the upper portion 128 of the cover 114) of the chassis 108) when the antenna module 110 is coupled to the chassis 108. This may lower a pivot point of the antenna module 110, which may further help improve resistance of the antenna module 110 to forces (e.g., wind forces, etc.) applied to the antenna module 110 (e.g., to sides of the cover of the antenna module 110, etc.) during use of the antenna assembly 100 with a mobile platform (e.g., when installed to the automobile 105, etc.).

In other exemplary embodiments, antenna assemblies may include rail mounts having other than I-type shapes. For example, antenna assemblies may include rail mounts having, for example, box shapes, shapes corresponding to the letter C of the English alphabet, the Greek symbol sigma Σ, etc.

Also in the illustrated embodiment, the antenna element 148 is at least partially disposed within the rail mount 146 of the antenna module 110 through the opening 162 of the rail mount 146. And the rail mount 146 is coupled to the chassis 108 (e.g., the projecting portions 140 and 142 of the channel 126 are received into the corresponding first and second longitudinal slots 156 and 158 of the rail mount 146, etc.) at a location generally below the upper portion 128 of the chassis's cover. This positioning of the rail mount 146 and antenna element 148 generally within the chassis 108 may provide for a reduced overall height dimension of the antenna module 110 and thus of the antenna assembly 100 as compared to other antenna assemblies.

Further, different antenna elements may be included in the antenna module 110 of the present disclosure. For example, antenna elements configured to receive, transmit, etc. circularly polarized signals, which may include satellite radio signals, global positioning system (GPS) signals, cell phone signals, or combinations thereof may be used. Antenna elements may also include, for example, patch antenna elements, monopole antenna elements, directional antenna elements, multi-directional antenna elements, etc. In addition, two or more antenna elements may be included within the rail mount 146 within the scope of the present disclosure.

The cover 114 of the chassis 108 and the cover 150 of the antenna module 110 may both be formed (e.g., molded, etc.) from a wide range of materials, such as polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), among other suitable materials within the scope of the present disclosure. And the base plate 112 of the chassis 108 may be formed from materials similar to those used to form the covers 114 and 150. Alternatively, the base plate 112 may be formed from metallic materials such as steel, zinc, or other suitable materials (including composites) by suitable forming processes, for example, die cast processes within the scope of the present disclosure.

In other example embodiments, chassis may include channels each having less or more than two projecting portions; and antenna modules may include rail mounts having more than or less than two longitudinal slots. And in still other example embodiments, chassis may include channels having projecting portions located differently than disclosed herein, for example, on bottom walls of the channels, etc.; and antenna modules may include rail mounts having slots located differently than disclosed herein, for example, on lower surfaces of the rail mounts, etc.

In still other example embodiments, chassis may include channels each having one or more longitudinal slots, and antenna modules may include rail mounts each having one or more projecting portions generally corresponding to the channels' one or more slots. In these embodiments, for example, the antenna modules can be coupled to the chassis by positioning (e.g., sliding, etc.) the rail mounts of the antenna modules into the channels of the chassis. For example, the rail mounts can initially be aligned with the channels of the chassis such that the one or more projecting portions of the rail mounts are generally aligned with the one or more longitudinal slots of the channels. The rail mounts (and thus the antenna modules) can then be moved longitudinally (e.g., slid longitudinally, etc.) into the channels with the one or more projecting portions of the rail mounts received into (and moved generally through) the corresponding one or more longitudinal slots of the channels.

Figure 13:
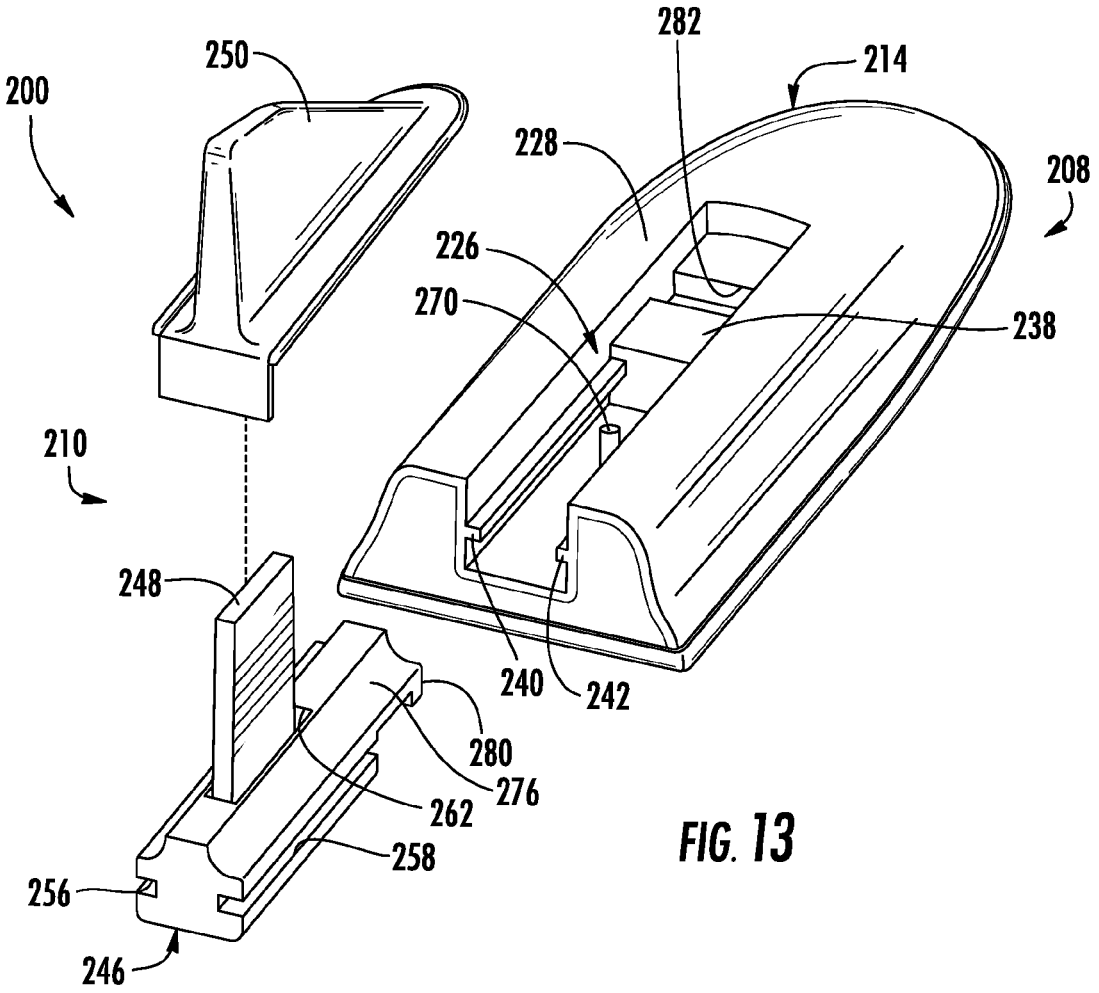
FIG. 13 is an exploded perspective view of an antenna assembly according to another example embodiment of the present disclosure.
Figure 14:
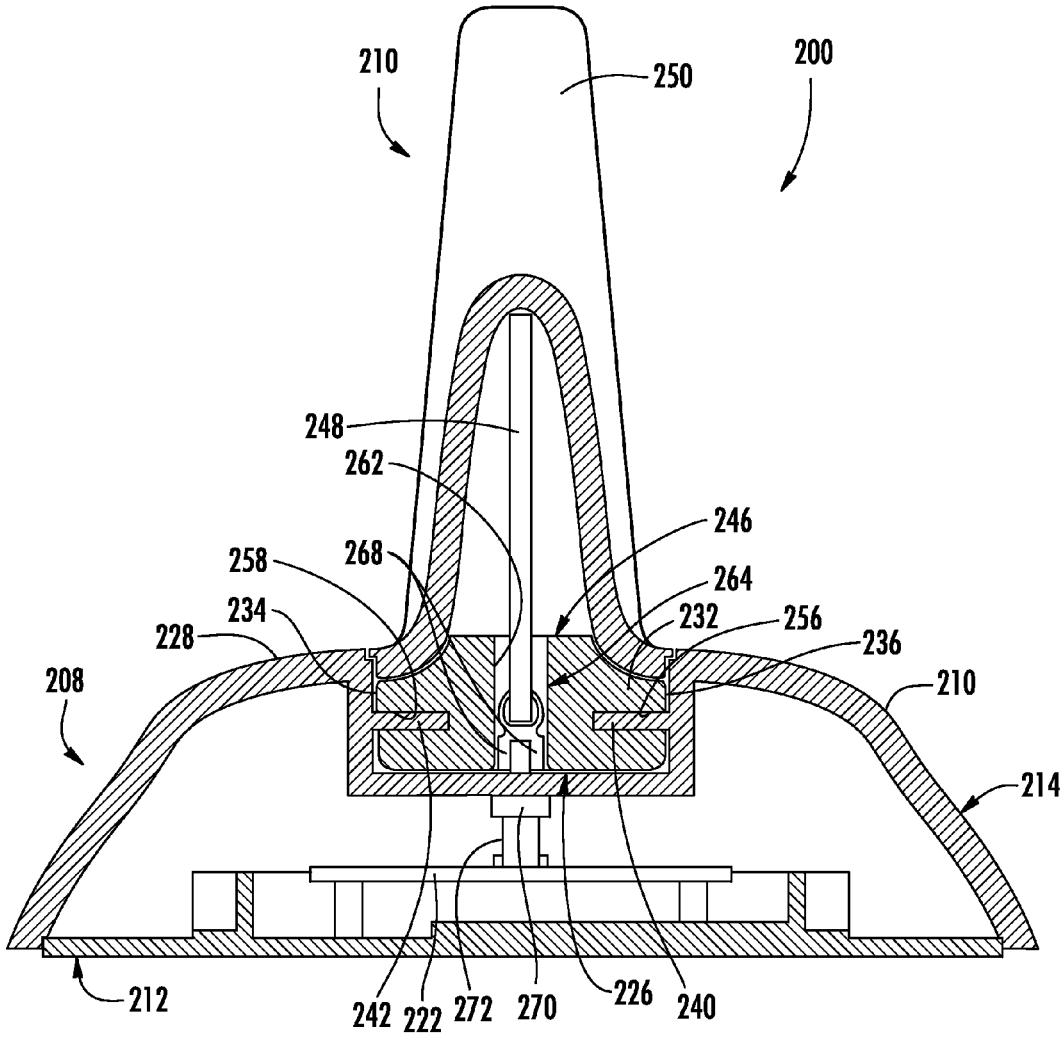
FIG. 14 is a rearward section view of the antenna assembly of FIG. 13 when in generally assembled form.

FIGS. 13 and 14 illustrate another example embodiment of an antenna assembly 200 including one or more aspects of the present disclosure. The antenna assembly 200 of this embodiment may be installed to a mobile platform such as a roof of an automobile (not shown). The illustrated antenna assembly 200 generally includes a chassis 208 and an antenna module 210 supported by the chassis 208. The chassis 208 includes a generally flat and thin base plate 212 and an outer, generally concave cover 214 coupled to the base plate 212 for supporting the cover 214 thereabove. The cover 214 defines a channel 226 extending generally longitudinally along an upper portion 228 of the cover 214.

The antenna module 210 includes a rail mount 246, an antenna element 248 supported generally above the rail mount 246, and an outer cover 250 configured (e.g., sized, shaped, constructed, etc.) to fit over the antenna element 248 and rail mount 246. The antenna element 248 is supported by the rail mount 246 generally within an opening 262 extending through the rail mount 246. A spring clip 264 is coupled to a lower edge portion of the antenna element 248 generally within the rail mount's opening 262, for example, for use in electrically coupling the antenna element 248 to the chassis 208 (and a printed circuit board (PCB) 222 via a connector 270 located within the channel 226 of the chassis 208 and a link 272 located above the PCB 222) when the antenna module 210 is coupled to the chassis 208.

The illustrated antenna module 210 can be coupled to the chassis 208 by positioning (e.g., sliding, etc.) the rail mount 246 of the antenna module 210 into the channel 226 of the chassis 208. For example, the rail mount 246 can initially be aligned with the channel 226 of the chassis 208 such that first and second projecting portions 240 and 242 of the channel 226 are generally aligned with the corresponding first and second longitudinal slots 256 and 258 of the rail mount 246, and the connector 270 positioned within the channel 226 is generally aligned with the rail mount's opening 262. The rail mount 246 (and thus the antenna module 210) can then be moved longitudinally (e.g., slid longitudinally, etc.) into the channel 226 with the projecting portions 240 and 242 of the channel 226 received into (and moved generally through) the corresponding first and second longitudinal slots 256 and 258 of the rail mount 246. And the connector 270 can be received into a slotted portion (not visible) of the rail mount's opening 262 that extends longitudinally along the lower surface of the rail mount 246 from about the antenna element 248 to an opening (not visible) generally under a forward lip 276 of the rail mount 246.

When the rail mount 246 is fully positioned within the chassis's channel 226, the forward lip 276 of the rail mount 246 is located generally over a forward plateau 238 of the channel 226, a lower surface of the rail mount 246 is located generally adjacent the upper surface of the channel 226, and a rearward surface of the rail mount 246 is generally flush with a rearward surface of the chassis's cover 214. And the connector 270 is positioned within the opening 262 of the rail mount 246 generally between resilient legs 268 of the spring clip 264 and thus in electrical contact with the spring clip 264 (and the antenna element 248). In this position, the antenna module 210 may be at least partially frictionally retained on the chassis 208 (e.g., by the projecting portions 240 and 242 of the channel 226 received into the corresponding first and second longitudinal slots 256 and 258 of the rail mount 246; by the connector 270 positioned generally between the resilient legs 268 of the spring clip 264; etc.) against forces (e.g., wind forces, etc.) tending to move the antenna module 210 rearwardly and off the chassis 208.

In this embodiment, a resilient retaining clip 280 located toward a forward end portion of the lip 276 can be received within an opening 282 defined in the forward plateau 238 of the channel 226 to further help retain the antenna module 210 on the chassis 208 (when assembled). For example, when the rail mount 246 is moved into the chassis's channel 226, a forward surface of the retaining clip 280 engages the forward plateau 238 and urges, cams, flexes, etc. the retaining clip 280 generally upwardly (e.g., via a cam surface, etc.). This allows the retaining clip 280 to move over the plateau 238 and resiliently into the opening 282 when the rail mount 246 is fully positioned within the chassis's channel 226. In this position, the retaining clip 280 may further help hold the antenna module 210 on the chassis 208 against forces (e.g., wind forces, etc.) tending to move the antenna module 210 in a rearward direction off the chassis 208.

If desired, the antenna module 210 can subsequently be removed from the chassis 208, for example, for maintenance, repair, replacement, etc. For example, a user can apply sufficient force to the antenna module 210 to overcome the frictional forces retaining the rail mount 246 in the channel 226 and to urge, cam, flex, etc. the retaining clip 280 generally upwardly and out of the plateau's opening 282, and thus move (e.g., slide, etc.) the rail mount 246 out of the chassis's channel 226. Desired maintenance, repair, etc. can be performed on the antenna module 210, and the antenna module 210 can then again be moved back into the chassis 208. Alternatively, a different (e.g., replacement, etc.) antenna module could be moved into the chassis 208. Thus, it can be seen that the chassis 208 may be configured to interchangeably receive various different antenna modules that include, for example, a rail mount (e.g., 246, etc.) configured (e.g., sized, shaped, constructed, etc.) to be slidably engaged, received, into a channel (e.g., 226, etc.) of the chassis 208.

Figure 15:
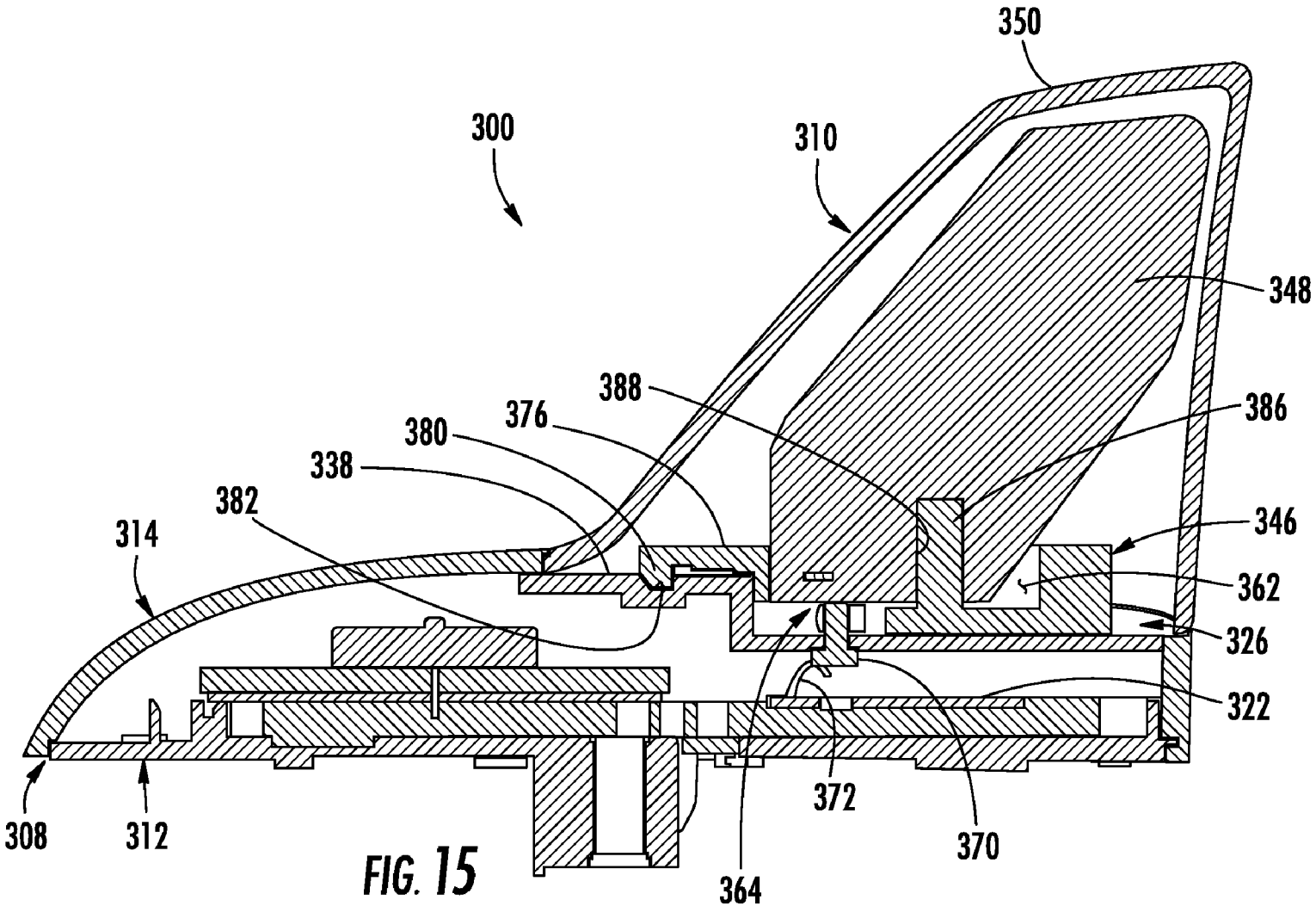
FIG. 15 is a side longitudinal section view of an antenna assembly according to a further example embodiment of the present disclosure including a dual band antenna element.

FIG. 15 illustrates another example embodiment of an antenna assembly 300 including one or more aspects of the present disclosure. The antenna assembly 300 of this embodiment is generally similar to the antenna assembly 200 previously described and illustrated in FIGS. 13 and 14. For example, the antenna assembly 300 generally includes a chassis 308 supporting an antenna module 310 generally above the chassis 308. The chassis 308 includes a base plate 312 and a cover 314, and the antenna module 310 includes a rail mount 346, an antenna element 348, and a cover 350. The antenna element 348 is supported by the rail mount 346 generally within an opening 362 extending through the rail mount 346. The illustrated rail mount 346 includes a support member 386 within the opening 362 that is configured (e.g., sized, shaped, constructed, etc.) to be received within a corresponding aperture 388 of the antenna element 348 for coupling the antenna element 348 to the rail mount 346. And a spring clip 364 is coupled to a lower edge portion of the antenna element 348 generally within the rail mount's opening 362, for example, for use in electrically coupling the antenna element 348 to the chassis 308 (and a printed circuit board (PCB) 322 located therein via a connector 370 located within the channel 326 of the chassis 308 and a link 372 located above the PCB 322) when the antenna module 310 is positioned in the chassis 308. In addition, a resilient retaining clip 380 located toward a forward end portion of the lip 376 can be received within an opening 382 defined in the forward plateau 338 of the channel 326 to further help retain the antenna module 310 on the chassis 308 (when assembled).

In this embodiment, however, the antenna element 348 includes a dual band antenna element 348 configured and tuned, for example, to receive electrical resonance frequencies over two distinct, non-overlapping frequency bandwidths, such as a first bandwidth ranging from about 800 MHz to about 1000 MHz (including frequencies associated with one of the AMPS, GSM 850, and GSM 900 systems) and a second bandwidth ranging from about 1720 MHz to about 1990 MHz (including frequencies associated with one of the GSM 1800, PCS, and GSM 1900 systems).

Figure 16:
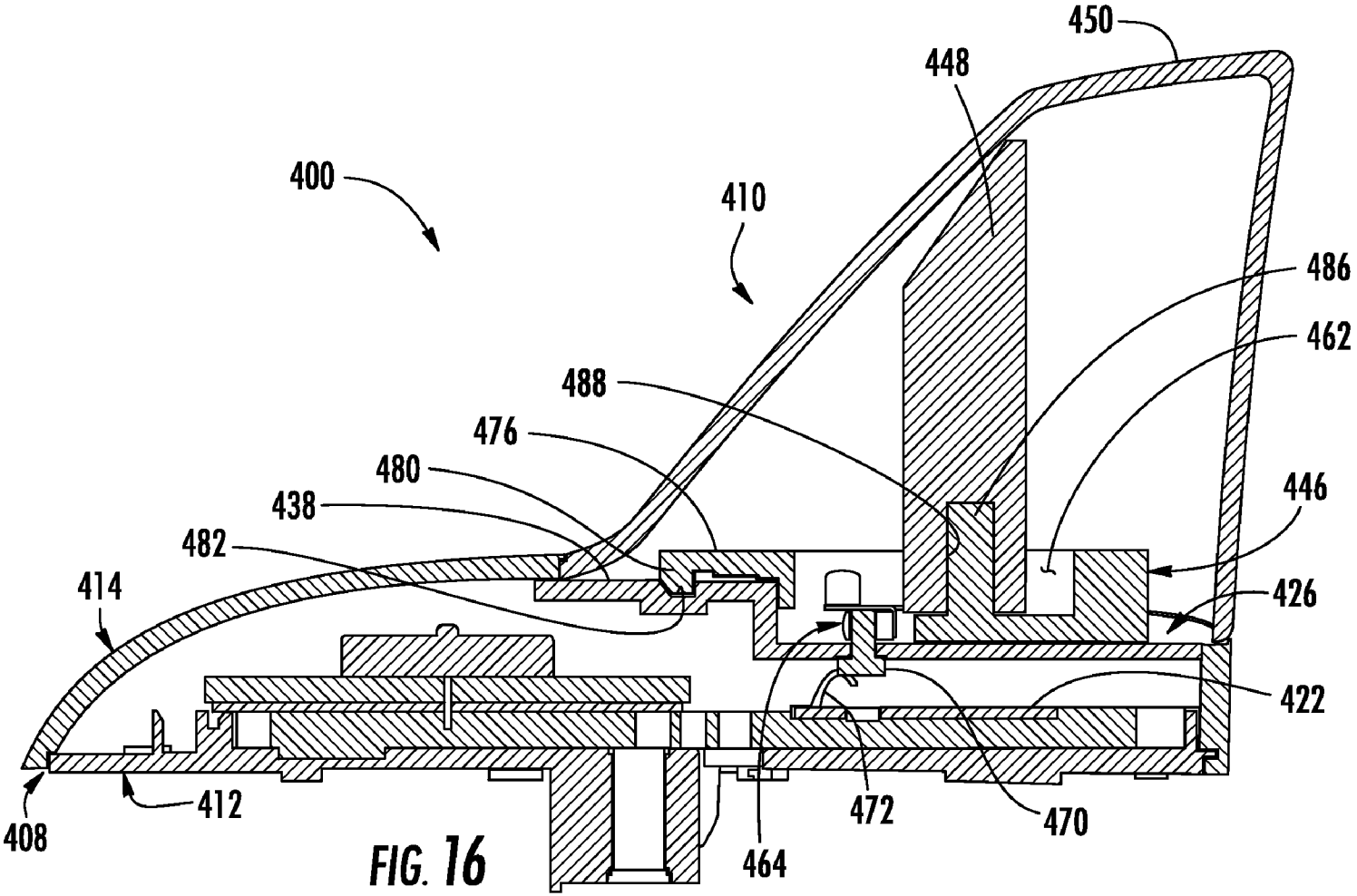
FIG. 16 is a side longitudinal section view of an antenna assembly according to another example embodiment of the present disclosure including a tri-band antenna element.

FIG. 16 illustrates still another example embodiment of an antenna assembly 400 including one or more aspects of the present disclosure. The antenna assembly 400 of this embodiment is generally similar to the antenna assembly 200 previously described and illustrated in FIGS. 13 and 14. For example, the antenna assembly 400 generally includes a chassis 408 supporting an antenna module 410 generally above the chassis 408. The chassis 408 includes a base plate 412 and a cover 414, and the antenna module 410 includes a rail mount 446, an antenna element 448, and a cover 450. The antenna element 448 is supported by the rail mount 446 generally within an opening 462 extending through the rail mount 446. For example, the illustrated rail mount 446 includes a support member 486 within the opening 462 that is configured (e.g., sized, shaped, constructed, etc.) to be received within a corresponding aperture 488 of the antenna element 448 for coupling the antenna element 448 to the rail mount 446. And a spring clip 464 is coupled to a lower edge portion of the antenna element 448 generally within the rail mount's opening 462, for example, for use in electrically coupling the antenna element 448 to the chassis 408 (and a printed circuit board (PCB) 422 located therein) when the antenna module 410 is positioned in the chassis 408.

In this embodiment, however, the antenna element 448 includes a tri-band antenna element 448 configured and tuned to receive electrical resonance frequencies over three distinct, non-overlapping frequency bandwidths, such as a first bandwidth ranging from about 800 MHz to about 1000 MHz (including frequencies associated with one of the AMPS, GSM 850, and GSM 900 systems), a second bandwidth ranging from about 1720 MHz to about 1990 MHz (including frequencies associated with one of the GSM 1800, PCS, GSM 1900 systems), and a third bandwidth ranging from about 2400 MHz to about 2500 MHz (including frequencies associated with one or more of the WiFi and/or Bluetooth systems).

Figure 17:
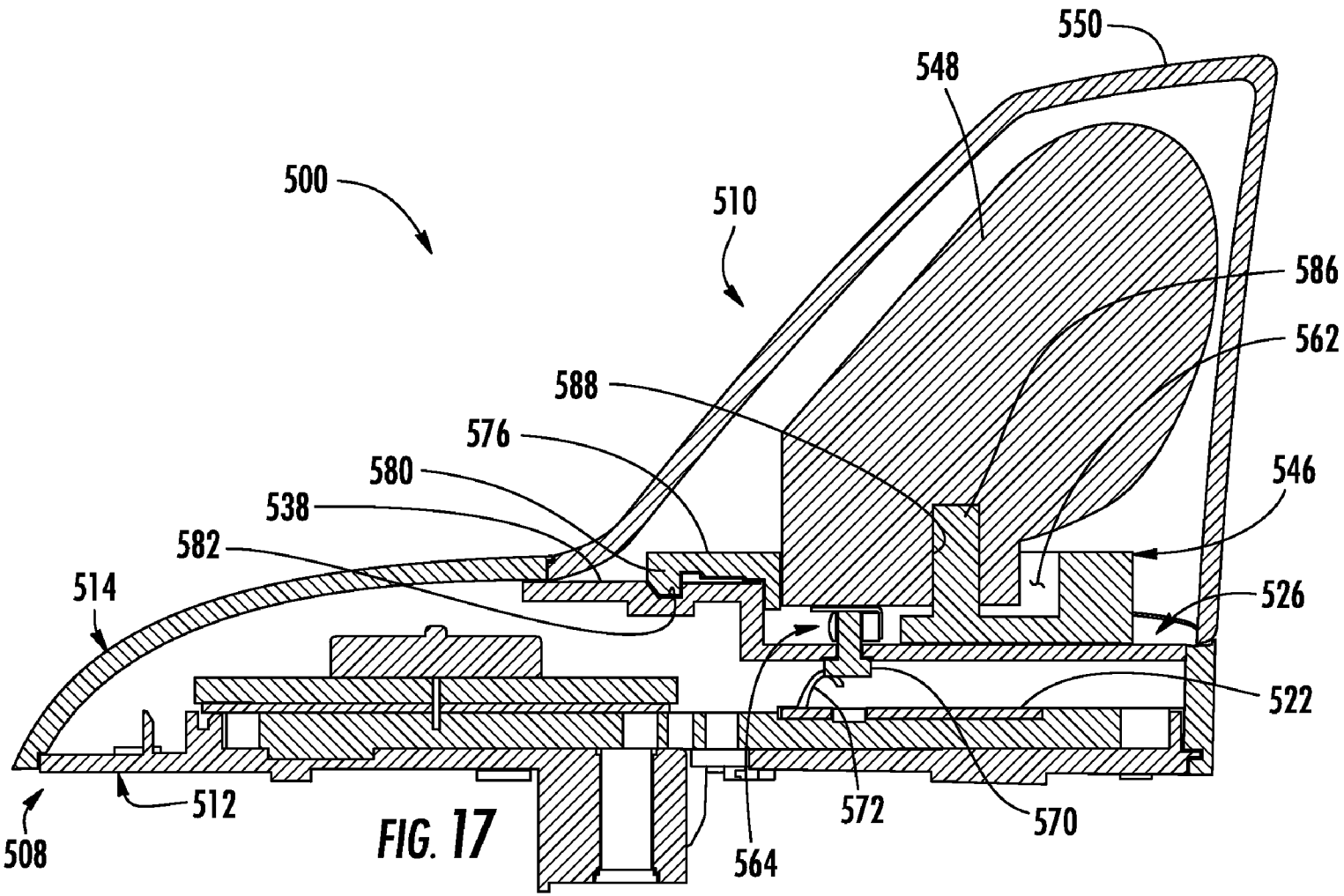
FIG. 17 is a side longitudinal section view of an antenna assembly according to still another example embodiment of the present disclosure including a multiband antenna element.

FIG. 17 illustrates a further example embodiment of an antenna assembly 500 including one or more aspects of the present disclosure. The antenna assembly 500 of this embodiment is generally similar to the antenna assembly 200 previously described and illustrated in FIGS. 13 and 14. For example, the antenna assembly 500 generally includes a chassis 508 supporting an antenna module 510 generally above the chassis 508. The chassis 508 includes a base plate 512 and a cover 514, and the antenna module 510 includes a rail mount 546, an antenna element 548, and a cover 550. The antenna element 548 is supported by the rail mount 546 generally within an opening 562 extending through the rail mount 546. For example, the illustrated rail mount 546 includes a support member 586 within the opening 562 that is configured (e.g., sized, shaped, constructed, etc.) to be received within a corresponding aperture 588 of the antenna element 548 for coupling the antenna element 548 to the rail mount 546. And a spring clip 564 is coupled to a lower edge portion of the antenna element 548 generally within the rail mount's opening 562, for example, for use in electrically coupling the antenna element 548 to the chassis 508 (and a printed circuit board (PCB) 522 located therein) when the antenna module 510 is positioned in the chassis 508.

In this embodiment, however, the antenna element 548 includes a multiband antenna element 548 configured and tuned to receive electrical resonance frequencies over three or more distinct, non-overlapping frequency bandwidths, such as a first bandwidth ranging from about 800 MHz to about 1000 MHz (including frequencies associated with one of the AMPS, GSM 850, and GSM 900 systems), a second bandwidth ranging from about 1650 MHz to about 2200 MHz (including frequencies associated with one of the GSM 1800, PCS, GSM 1900, and UMTS systems), and a third bandwidth ranging from about 2400 MHz to about 2500 MHz (including frequencies associated with one or more of the WiFi and/or Bluetooth systems).

Embodiments of the present disclosure should not be limited to any particular frequency or frequency bandwidth. Rather, embodiments disclosed herein may include slidably mountable antenna modules having antenna elements configured and tuned to receive electrical resonance frequencies over one or more frequency bandwidths, for example, a bandwidth ranging from about 800 MHz to about 1000 MHz (including frequencies associated with one of the AMPS, GSM 850, and GSM 900 systems), a bandwidth ranging from about 1650 MHz to about 2700 MHz (including frequencies associated with one of the GSM 1800, PCS, GSM 1900, and UMTS systems), and/or a bandwidth ranging from about 2400 MHz to about 2500 MHz (including frequencies associated with one or more of the WiFi and/or Bluetooth systems). Some example embodiments are capable of ultra-wideband operation, receiving bands of radio frequencies substantially covering the different cellular network standards currently in use, such as AMPS, GSM 900, GSM 1800, PCS, UMTS, WiFi, WiMax, Bluetooth systems, etc.

It should be appreciated that antenna modules (e.g., 110, 210, 310, 410, 510, etc.) disclosed herein could each be interchanged with any one of the chassis (e.g., 108, 208, 308, 408, 508, etc.) disclosed herein. Each chassis (e.g., 108, 208, 308, 408, 508, etc.) could thus be configured for operation with a desired antenna module (and desired antenna element included with the antenna module). Moreover, the chassis (e.g., 108, 208, 308, 408, 508, etc.) could include a universal chassis each having substantially similar projecting portions (e.g., 140 and 142; 240 and 242; etc.) within a channel (e.g., 126, 226, etc.). And the antenna modules (e.g., 110, 210, 310, 410, 510, etc.) could include universal rail mounts (e.g., 146, 246, 346, 446, 546, etc.) (each with differing antenna elements, etc.) such that each antenna assembly (with each differing antenna element, etc.) can be positioned within each universal chassis. This can provide for interchangeability of antenna modules with a uniform chassis.

For example, prior to installation of an antenna assembly to a mobile platform (e.g., prior to automobile assembly, etc.), a customer may request an antenna assembly capable of a desired usage (e.g., capable of operation over a desired range of frequencies, etc.). A particular antenna module can then be selected based on the customer's request. After selecting the antenna module, a chassis can be installed to the desired mobile platform and the selected antenna module coupled thereto.

Alternatively, the chassis can be installed to a desired mobile platform (e.g., a roof of an automobile, etc.) and transported to a customer without an antenna module coupled thereto. The customer may then request an antenna module capable of a desired usage (e.g., capable of operation over a desired range of frequencies, etc.). A particular antenna module can then be selected and coupled to the chassis.

It should be understood that embodiments and aspects of the present disclosure may be used in a wide range of antenna applications, such as patch antennas, telematics antennas, antennas configured for receiving satellite signals (e.g., Satellite Digital Audio Radio Services (SDARS), Global Positioning System (GPS), cellular signals, etc.), antennas configured for receiving RF energy or radio transmissions (e.g., AM/FM radio signals, etc.), combinations thereof, among other applications in which wireless signals are communicated between antennas. Accordingly, the scope of the present disclosure should not be limited to only one specific form/type of antenna assembly.

Communication using cell phones is a growing part of personal telecommunications. Various cellular networks are in place to allow communications between, for example, different cell phone users. However, as cellular communication increases, network providers have developed different standards for operation, typically meaning operation expanded to different radio frequency bands. For example, the Advanced Mobile Phone System (AMPS) operates in the 800 Megahertz (MHz) frequency band. The Global System for Mobile Communications (GSM) generally operates in the 900 MHz and 1800 MHz frequency bands in Europe, but in the 850 MHz and 1900 MHz frequency bands in the United States. The Personal Communications Service (PCS) operates in the 1900 MHz frequency band. The Universal Mobile Telecommunications System (UMTS) operates in the 1900 MHz to 1980 MHz frequency band for uplinks and in the 2110 MHz to 2170 MHz frequency band for downlinks.

Making cellular communication available in automobiles is important. To accomplish this, antenna systems having one or more antennas may be installed to generally flat and/or metallic surfaces of the automobiles (e.g., to the roof, hood, trunk, etc.) for receiving different cellular frequencies and enabling cell phone users to communicate with, for example, other cell phone users. Typically, though, for a user to receive frequencies in more than one frequency band (e.g., based on more than one network standard, etc.), the antenna system includes multiple antennas configured to receive one or more of the desired frequency bands.

Advantageously, embodiments disclosed herein may allow multiple antenna types (e.g., fin assemblies or structured tuned to different frequency bandwidths, etc.) to be fitted to one common base module, which, in turn, should help reduce installation errors and logistical issues in the automotive assembly plants. Accordingly, aspects of the present disclosure may allow for use of a common antenna mounting base across a wide range of various antenna types, despite the different shapes and design sizes typically used for different antenna frequencies. With the interface configurations disclosed herein, a particular antenna assembly (selected from a number different types) is capable of being slidably mounted to a base module, with a portion of the antenna element (e.g., antenna mast, etc.) disposed within and below the top of the base module, to thereby provide a reduced height relative to the antenna base module. By allowing for the use of a single, common antenna base design for use with different antenna types, aspects of the present disclosure allow for common parts and tooling to be used for antenna installation, which may, in turn allow for reduced costs.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An antenna assembly for installation to an exterior portion of a mobile platform, the antenna assembly comprising:

a base portion having a longitudinal axis and defining a channel extending generally along at least part of the longitudinal axis, the base portion configured to be coupled to the exterior portion of the mobile platform;

an antenna module configured to be coupled to the base portion, the antenna module including:

a mount removably receivable within the channel of the base portion;

an antenna element coupled to the mount, the antenna element tuned to receive electrical resonance frequencies over one or more bandwidths; and an outer cover coupled to the mount and disposed over the antenna element;

wherein the outer cover comprises a fin-shaped cover configured to receive at least part of the antenna element and at least part of the mount into the fin-shaped cover.

2. The antenna assembly of claim 1, wherein the channel of the base portion includes at least one projecting portion, and wherein the mount includes at least one slot, the slot of the mount receiving the projecting portion of the base portion's channel when the mount is received within the base portion's channel.

3. The antenna assembly of claim 2, wherein the base portion includes an upper surface, the at least one projecting portion of the base portion's channel being disposed generally within the channel and below the base portion's upper surface.

4. The antenna assembly of claim 1, wherein the mount includes an opening, and the antenna element includes an end portion coupling the antenna element to the mount within said opening.

5. The antenna assembly of claim 4, wherein the base portion includes an upper surface, the end portion of the antenna element being positioned below the base portion's upper surface when the mount is received within the base portion's channel.

6. The antenna assembly of claim 1, wherein the mount defines an English alphabetic capital letter I.

7. The antenna assembly of claim 1, wherein the base portion's channel is configured to interchangeably receive two or more different antenna modules having different types of antenna elements including one or more of a vertically extending antenna mast, a patch antenna, a monopole element, a directional antenna element, a multi-directional antenna element, a radiating element on a printed circuit board, and a planar inverted F-antenna, thereby allowing a selected one of the two or more different antenna modules and one or more antenna elements thereof to be selectively coupled to the base portion.

8. The antenna assembly of claim 7, wherein the antenna element is configured to receive circularly polarized signals selected from the group consisting of satellite radio signals, global positioning system signals, cell phone signals, and combinations thereof.

9. The antenna assembly of claim 1, wherein the base portion's channel includes a plateau having an opening formed therein, and wherein the mount includes a resilient retaining clip, the retaining clip moving into the opening of the plateau when the mount is received within the channel of the base portion to thereby help retain the mount within the channel of the base portion.

10. The antenna assembly of claim 1, further comprising a connector disposed at least partially within the channel of the base portion, the connector being in electrical contact with a printed circuit board disposed generally within the base portion.

11. The antenna assembly of claim 10, wherein the mount includes a lower surface and an opening extending at least partially through the lower surface, the connector being received at least partially within said opening in electrical contact with the antenna element when the mount is received within the base portion's channel.

12. The antenna assembly of claim 11, further comprising a spring clip disposed at least partially within said opening of the mount and coupled to the antenna element, the spring clip resiliently engaging the connector when the mount is received within the base portion's channel for electrically connecting the antenna element to the connector.

13. The antenna assembly of claim 1, wherein the base portion is configured for use as a common base portion with different interchangeable antenna modules having different types of antenna elements, thereby allowing a selected one of the different interchangeable antenna modules to be coupled to the base portion.

14. A vehicle including a vehicle body wall and the antenna assembly of claim 1 coupled to an exterior portion of the vehicle body wall, and wherein the antenna assembly has a generally fin-shape defined by the antenna module and the base portion when the antenna module is coupled to the base portion.

15. The antenna assembly of claim 1, further comprising a printed circuit board disposed within the base portion for receiving signal input from the antenna element when the mount is received within the channel of the base portion.

16. The antenna assembly of claim 1, wherein the base portion includes a guide configured to be positioned at least partly within an opening of the exterior portion of the mobile platform to help locate the base portion on the exterior portion of the mobile platform when the base portion is coupled to the exterior portion of the mobile platform.

17. An antenna assembly for installation to an exterior portion of a mobile platform, the antenna assembly comprising:

a base portion having a longitudinal axis and defining a channel extending generally along at least part of the longitudinal axis, the channel having first and second side walls and first and second projecting portions, the first projecting portion extending generally along at least part of the first side wall, and the second projecting portion extending generally along at least part of the second side wall, the base portion configured to be coupled to the exterior portion of the mobile platform;

an antenna module configured to be coupled to the base portion, the antenna module including:

a mount having first and second side walls and first and second slots, the first slot extending generally along the first side wall, and the second slot extending generally along the second side wall;

an antenna element coupled to the mount, the antenna element tuned to receive electrical resonance frequencies over one or more bandwidths; and an outer cover coupled to the mount and disposed over the antenna element;

wherein the first and second projecting portions of the base portion's channel are received at least partially within the respective first and second slots of the mount to thereby releasably couple the mount to the base portion at least partially within the channel of the base portion; and wherein the outer cover comprises a fin-shaped cover configured to receive at least part of the antenna element and at least part of the mount into the fin-shaped cover.

18. The antenna assembly of claim 17, wherein the base portion's channel includes a plateau having an opening formed therein, and wherein the mount includes a resilient retaining clip, the retaining clip moving into the opening of the plateau when the mount is received within the channel of the base portion to thereby help retain the mount within the channel of the base portion.

19. The antenna assembly of claim 17, wherein the base portion is configured for use as a common base portion with different interchangeable antenna modules having different types of antenna elements, thereby allowing a selected one of the different interchangeable antenna modules and one or more antenna elements thereof to be selectively coupled to the base portion.

20. A vehicle including a vehicle body wall and the antenna assembly of claim 17 coupled to an exterior portion of the vehicle body wall, and wherein the antenna assembly has a generally fin-shape defined by the antenna module and the base portion when the antenna module is coupled to the base portion.

21. The antenna assembly of claim 17, wherein the mount includes an opening, and the antenna element includes an end portion coupling the antenna element to the mount within said opening.

22. The antenna assembly of claim 17, wherein the mount defines an English alphabetic capital letter I.

23. The antenna assembly of claim 17, wherein the mount includes a resilient retaining clip for use in releasably coupling the antenna module to the base portion mounted on the exterior portion of the mobile platform.

24. The antenna assembly of claim 17, wherein said channel includes a plateau having an opening formed therein for use in releasably coupling the antenna module to the base portion.

25. The antenna assembly of claim 17, further comprising a base plate for coupling the base portion to the exterior portion of the mobile platform, and a cover for generally enclosing components of the base portion between the cover and the base plate, said channel being formed at least partially within the cover.

26. The antenna assembly of claim 17, further comprising a printed circuit board disposed within the base portion for receiving signal input from the antenna element when the mount is coupled to the base portion.

27. The antenna assembly of claim 17, wherein the base portion includes a guide configured to be positioned at least partly within an opening of the exterior portion of the mobile platform to help locate the base portion on the exterior portion of the mobile platform when the base portion is coupled to the exterior portion of the mobile platform.

28. A method relating to installation of antenna assemblies to exterior portions of vehicle body walls, the method comprising:

coupling an antenna module of the antenna assembly to a base portion of the antenna assembly by sliding a mount of the antenna module generally longitudinally into a longitudinal channel of the base portion, wherein an outer cover is coupled to the antenna module and disposed over an antenna element coupled to the mount thereof, and wherein the outer cover comprises a fin-shaped cover configured to receive at least part of the antenna element and at least part of the mount into the fin-shaped cover;

wherein the base portion is mountable to an exterior portion of a vehicle body wall and configured for use as a common base portion with different interchangeable antenna modules having antenna elements; and wherein coupling an antenna module of the antenna assembly to the base portion includes sliding a selected one of the different interchangeable antenna modules generally longitudinally into a longitudinal channel of the base portion, thereby couple the selected one of the different interchangeable antenna modules and one or more antenna elements thereof to the base portion.

29. The method of claim 28, wherein coupling an antenna module of the antenna assembly to the base portion includes moving at least one projecting portion of the base portion into at least one slot of the antenna module.

30. The method of claim 29, wherein coupling an antenna module of the antenna assembly to the base portion further includes moving a retaining clip of the antenna module into an opening of the base portion.

31. The method of claim 29, wherein coupling an antenna module of the antenna assembly to the base portion further includes moving a connector of the base portion into electrical contact with a spring clip of the antenna module to thereby electrically couple the antenna module and the base portion.

32. The method of claim 28, wherein the method includes selecting a particular antenna module from the different interchangeable antenna modules that is configured for operation consistent with preferences of an end user of a vehicle, and slidably mounting the selected particular antenna module to the base portion that is already mounted to the vehicle.

33. The method of claim 28, further comprising locating a guide of the base portion at least partly within an opening of the exterior portion of the vehicle body wall to help locate the base portion on the exterior portion of the vehicle body wall when the base portion is mounted to the exterior portion of the vehicle body wall.

34. The method of claim 28, further comprising coupling the antenna module to a printed circuit board disposed within the base portion for receiving signal input from the antenna module.

* * * * *